United States Patent [19]

Schieser et al.

[11] Patent Number: 4,506,489

[45] Date of Patent: Mar. 26, 1985

[54] FILLER AND CAPPER FOR CONTAINERS

[75] Inventors: Warren J. Schieser, Dublin; Stanley E. Vickers, Hideaway Hills; Craig L. Duffey, Galena, all of Ohio

[73] Assignee: Liqui-Box Corporation, Worthington, Ohio

[21] Appl. No.: 523,075

[22] Filed: Aug. 15, 1983

[51] Int. Cl.[3] ..... B65B 57/00; B65B 3/26; B65B 7/28

[52] U.S. Cl. ..... 53/64; 53/281; 53/283; 53/306; 53/319

[58] Field of Search ..... 53/55, 64, 75, 202, 53/306, 319, 268, 281, 282, 283

[56] References Cited

U.S. PATENT DOCUMENTS

| | | | |
|---|---|---|---|
| 728,396 | 5/1903 | Jerram | 53/283 |
| 3,402,523 | 9/1968 | Mojonnier | 53/281 X |
| 3,405,500 | 10/1968 | Rupert | 53/283 X |
| 3,431,702 | 3/1969 | Spaulding | 53/281 |
| 3,445,984 | 5/1969 | Kelly | 53/281 X |
| 3,491,505 | 1/1970 | Hasselmann | 53/268 X |
| 3,493,146 | 2/1970 | Conners et al. | 222/153 |
| 3,529,399 | 9/1970 | Schieser et al. | 53/55 |
| 4,120,134 | 10/1978 | Scholle | 53/281 X |

*Primary Examiner*—Horace M. Culver
*Attorney, Agent, or Firm*—William V. Miller

[57] ABSTRACT

A container filling apparatus for simultaneously filling all containers in a group of containers with a desired volumetric quantity of liquid. A lead group of containers is separated from a line of unfilled containers received by the apparatus. The group of containers is sequentially subjected to a filling operation and to the application of sealing caps, followed by the discharge of the resulting group of filled and capped containers from the apparatus. Each group of containers is supported during the filling and capping operation for proper orientation of the fill openings.

49 Claims, 26 Drawing Figures

111
112
119
120
121
122
122a
122b
125
130
131
132
136
137
138
139
140
141
142
143
144
145
115
116
B
M
G
V
D
T
14

TO FIG. 18B
SUPPLY
DEL
FF
N
S

FROM FIG. 18A
TO FIG. 18C

PULSE
DEL
FF
N

FILLER AND CAPPER FOR CONTAINERS

BACKGROUND OF THE INVENTION AND PRIOR ART

This invention relates to a machine which automatically fills containers and applies caps thereto. The machine is useful, more particularly, with containers of the general type referred to in U.S. Pat. No. 3,493,146 which are of plastic and have semi-rigid walls and which are capped with snap-on or press-on dispensing valve-caps, although it is not limited thereto. A filler and capper machine is disclosed in U.S. Pat. No. 3,529,399 which was designed particularly for sub-surface filling the containers of this particular type with a liquid that tends to foam and special operations were required to prevent excessive foaming of the liquid, such as proper initial positioning of the nozzle in the container at the start of the filling operation and relative axial movement of the container and the nozzle as the filling progresses. The present machine is designed primarily for filling the containers with water and non-foaming flavored drink products and relative axial movement of the filling nozzles and containers is not required and does not occur during the filling operation. However, the machine could be modified readily for sub-surface filling.

The type of container specifically referred to in the following description is disclosed in both of said patents and, as indicated, the snap-on or press-on cap to be applied thereto is disclosed specifically in U.S. Pat. No. 3,493,146. These containers are formed from a plastic material in a rectangular, box-like configuration and are of a relatively thin-wall construction that may be classified as semi-rigid. The dispensing and filling opening of the container is formed at an angled corner which is of advantage in both filling the container and dispensing from it as described in said patents and in volume of containers in relation to volume of shipping containers which received these filled containers. However, in filling such a container, it must be oriented in a tilted position with the fill opening uppermost as this facillitates filling to complete capacity although this specific container is given as an example in the drawings and description of the machine of this invention, the machine is not limited thereto and can be adapted to handle other container configurations. Also, the machine is not limited to the specific cap structure disclosed as it could be readily adapted to other forms of caps. As indicated, the machine disclosed in U.S. Pat. No. 3,529,399 will fill containers of the particular kind described and apply press-on or snap-on caps of the particular type described. However, that machine was of limited capacity since it was only a two-head filler machine into cooperation with which the containers were fed alternately. Also, the caps were not handled completely automatically. Furthermore, that particular machine was designed as a sub-surface filling machine in which the platform, that supported the container during the filling operation, moved vertically.

BRIEF DESCRIPTION OF THE INVENTION

The machine of this invention is an in-line machine designed primarily for filling containers of the type indicated with water or non-foaming liquid products and then capping them with snap-on or press-on dispenser valve-caps of the type indicated. The empty containers are received on a continuously-running infeed conveyor and transferred in a group of a preselected number successively to filling heads where they are filled and then capped. The group of capped containers is then discharged onto a continously-running takeaway conveyor. The machine accommodates the semi-rigid type of container referred to in said patents, having the filling spout at an angled corner, by orienting the containers as they are fed into the machine and supporting them with the spout latched upright during the filling and capping operations. The filled and capped containers are re-oriented and discharged in a predetermined position for easy loading into cases or boxes, or for automatic casing downstream. The filler for the containers includes a fillhead above each container and each fillhead is controlled preferably by its own turbine meter and preset digital electronic counter for precise fill quantity control although timed-flow control could be used. The fillheads include columnar-stream forming nozzles which are precisely aligned with the successively-spaced spouts of the oriented and in-line containers and which create stable non-splashing streams. With this arrangement, no contact between the nozzles and the spouts is necessary and no relatively axial movement is required before, during, or after filling. This greatly simplifies the machine. A combination of pneumatic and electronic logic controls program and monitor machine operations. Also, cap-detecting means for detecting defective, mal-positioned or missing caps stops the machine when such detection occurs.

BRIEF DESCRIPTION OF THE DRAWINGS

The best mode contemplated in carrying out this invention is illustrated in the accompanying drawing in which.

BRIEF DESCRIPTION OF THE INVENTION

With specific references to the drawings, the in-line filling and capping machine of this invention is illustrated generally in FIGS. 1–4. It provides, in succession, a container-loading and orienting station L, a container-filling and capping station F, and a container-reorienting and removal station R.

Figure 1:
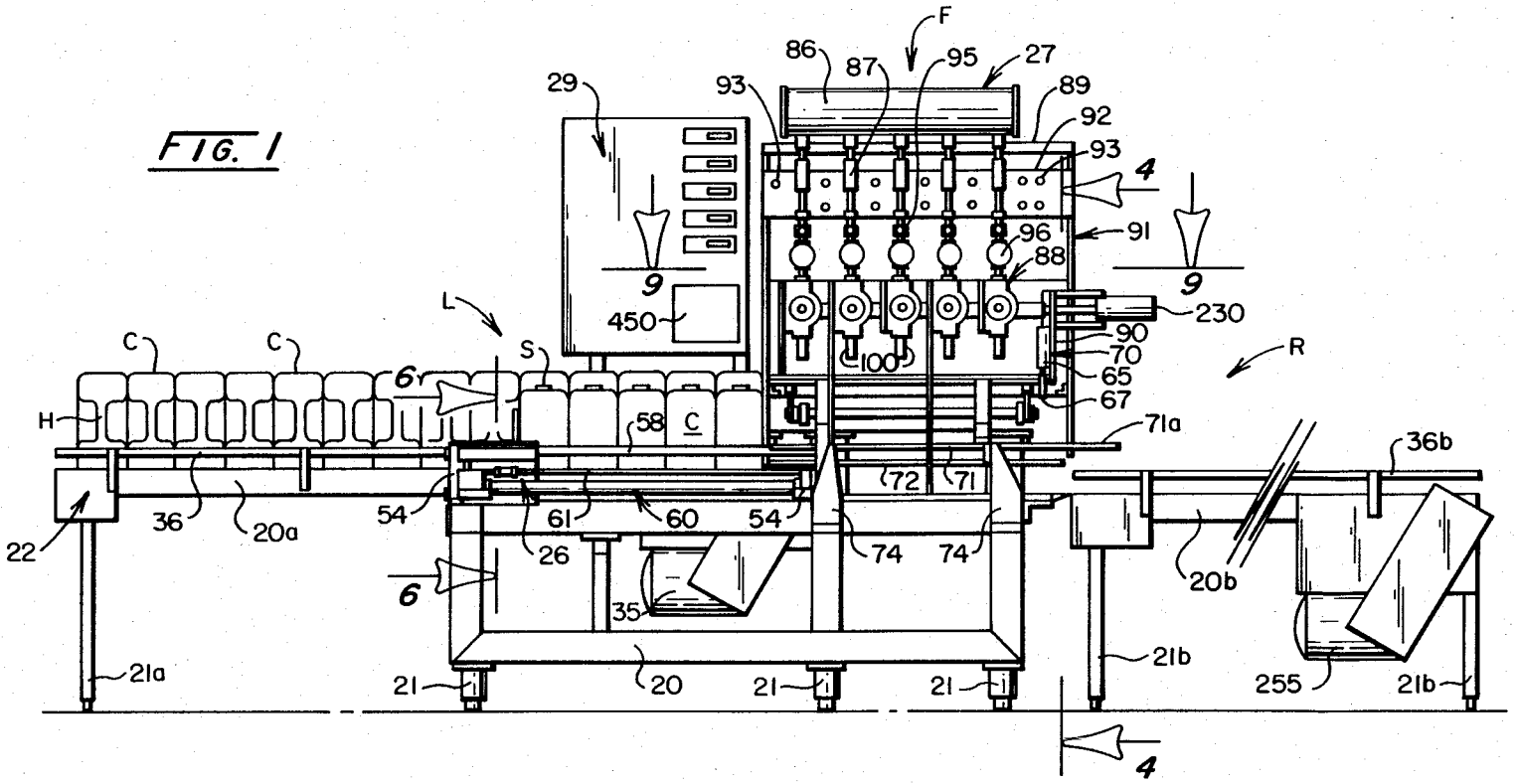
FIG. 1 is a side elevational view of the machine.
Figures 2, 2A:
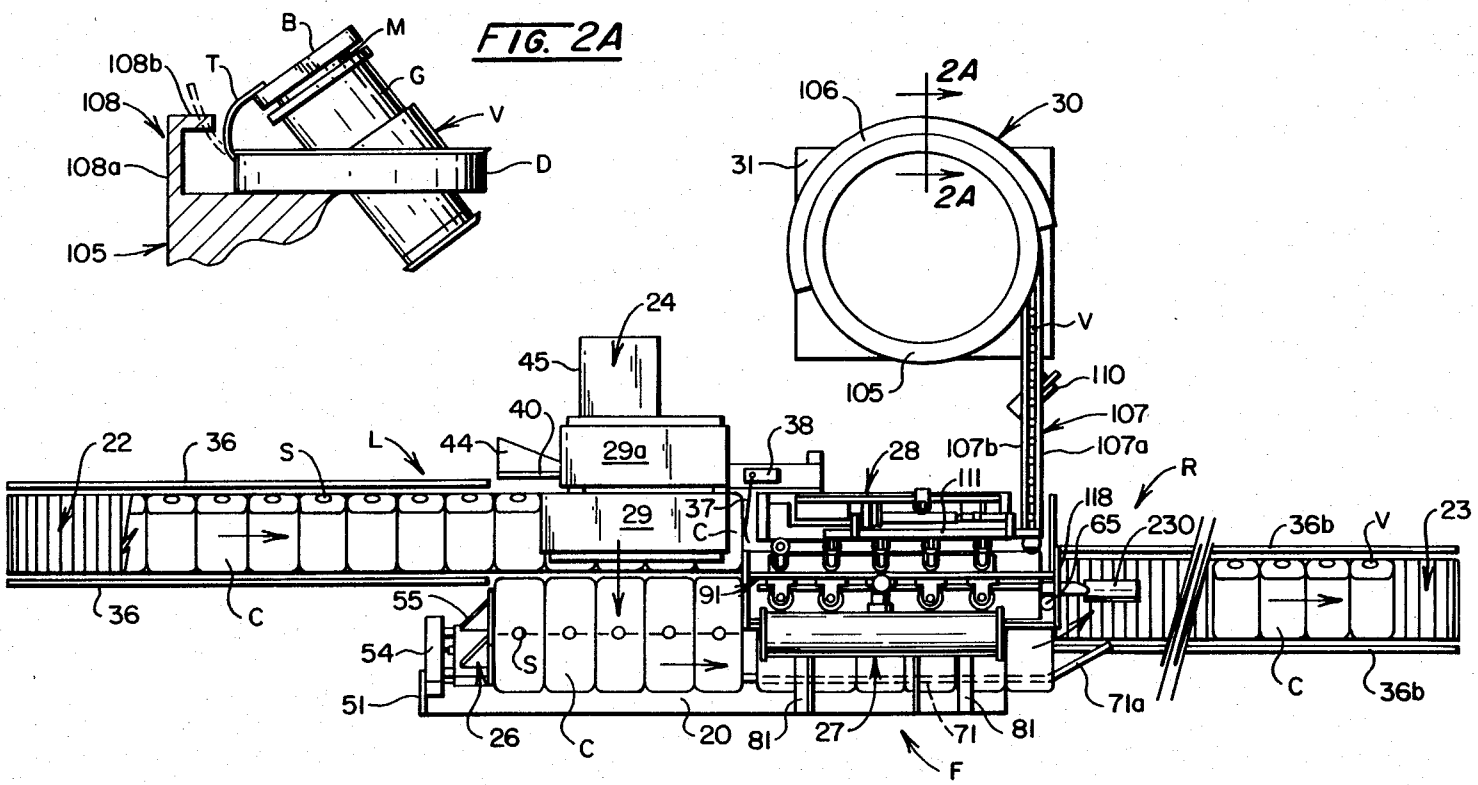
FIG. 2 is a plan view of the machine.
FIG. 2A is an enlarged vertical sectional view taken along line 2A—2A of FIG. 2 showing a defective cap detector.
Figure 3:
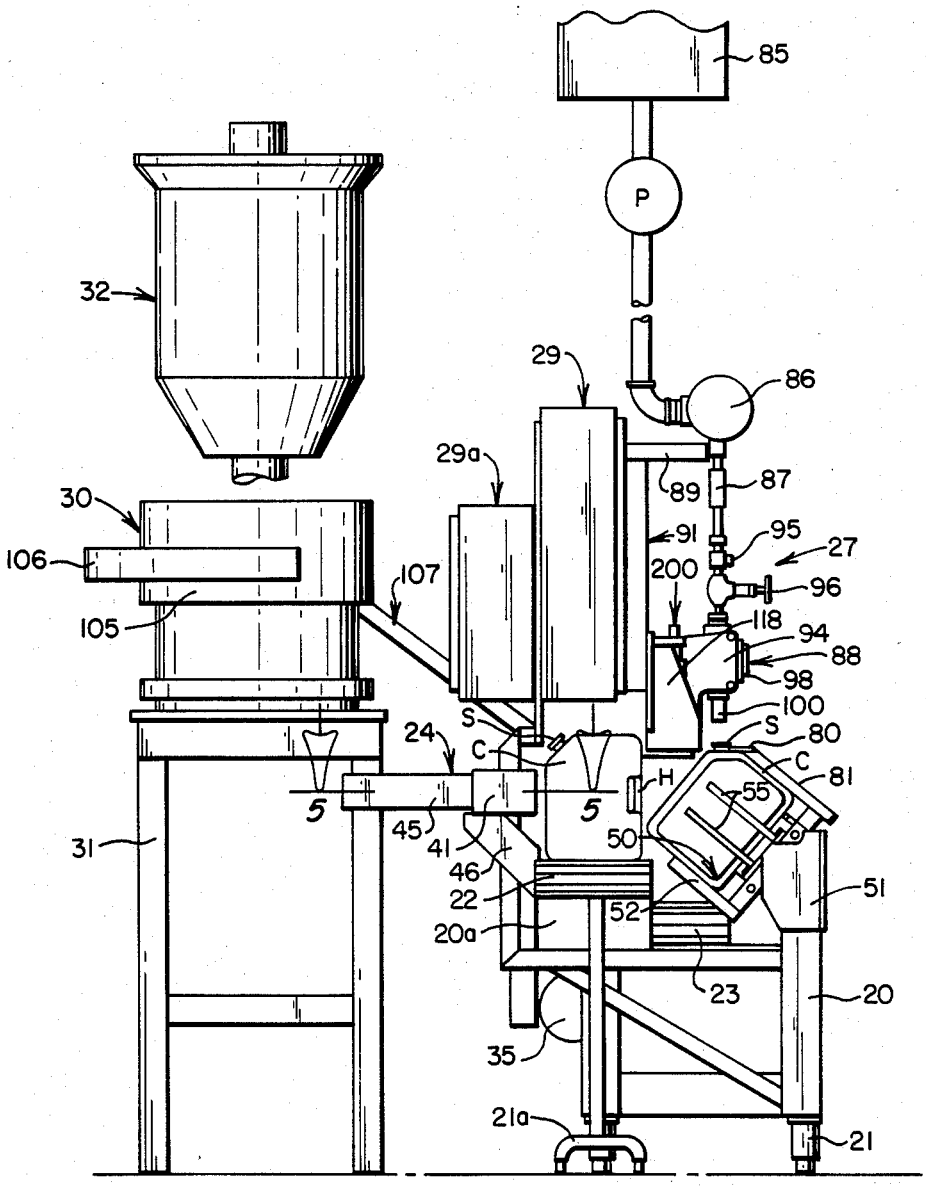
FIG. 3 is an end view of the machine, at the infeed or loading
Figures 12, 13, 14:
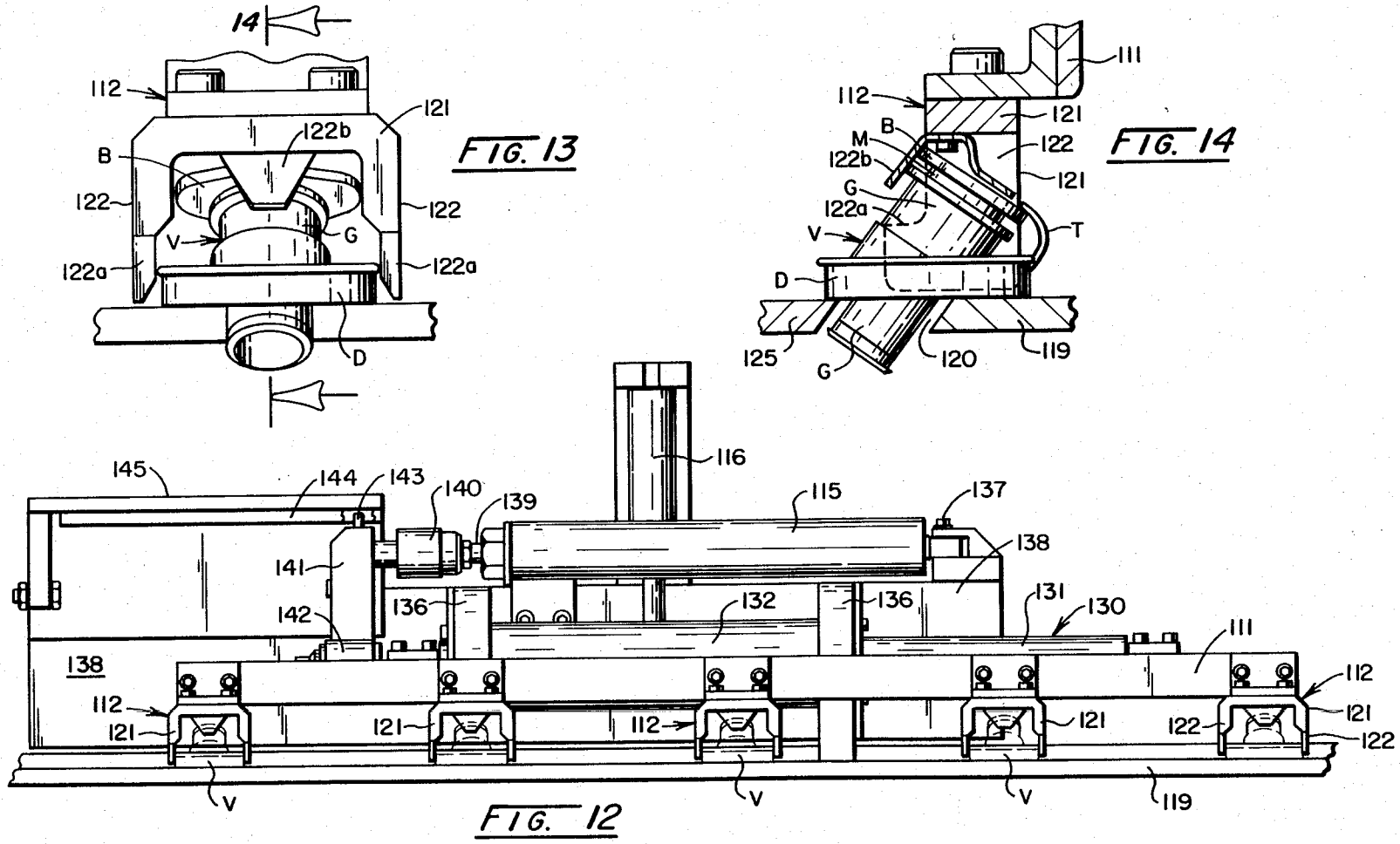
FIG. 12 is an enlarged longitudinal vertical sectional view taken along line 12—12 of FIG. 9.
FIG. 13 is an enlarged view of a cap shuttle flight with a cap inserted therein.
FIG. 14 is a sectional view taken along 14—14 of FIG. 13.

The container C which this machine is designed to fill and cap is of a special form as indicated in said patents. It is semi-rigid, mainly of rectangular block form (FIGS. 3 and 4) but one corner is formed at an angle and is provided with a filling or dispensing flanged spout S that is adapted to receive a cap V (FIG. 2A) of the valved dispensing type. This cap V is disclosed in detail in U.S. Pat. No. 3,493,146 and includes a tab or seal strip T which is fastened between the exposed button B of the slidable valve member M and the flanged snap-on disc-like cap portion D which supports the tubular valve guide G at an angle. The exposed outer push-button B on member M is of non-circular form (FIG. 13). The containers C are supplied to the machine as shown in FIGS. 1–3 in an unfilled condition and without caps, resting on a flat end with the spout S thereof being at the opposed end, which is uppermost at the time, the spout being on the angled corner and extending at about a 45° angle as indicated at the left-hand position in FIG. 3. At this time a handle H, which may be provided on the container C, is located at the opposite vertical side. To permit filling to capacity and to prevent formation of excessive air spaces in the container, which would occur if it were filled in this position, it is necessary to orient it before filling by tilting it to the right-hand position also illustrated in this Figure. This orientation occurs at the container loading station L. The containers C are filled and capped with the caps V in this oriented position at the filling and capping station F and are reoriented and discharged at the removal station R preferably in the same position in which they were supplied at the loading station L, as shown in FIG. 2, with handles H forward for easy loading into cases or boxes or for automatic casing downstream from the machine.

The machine, as shown in FIGS. 1 and 2, comprises a main supporting frame center section 20 which supports the main operating units and is carried on adjustable leveling legs 21, the left-hand extension 20*a* which supports part of the loading station L and is carried by vertically adjustable legs 21*a*, and the right-hand extension 20*b* which supports the removal station R and is carried by vertically adjustable legs 21*b*. The extension 20*a* carries part of the continuously-running infeed conveyor 22 and the extension 20*b* carries the continously-running takeaway conveyor 23. As indicated, the main center section supports the main operating units of the machine which are shown generally in FIGS. 1–4 and consist of a container crossfeed 24 at the container loading and infeed station L which moves a group of containers laterally forward off the infeed conveyor 22 into association with a container infeed advancer or pusher 26 which then pushes the group of containers to an advanced position longitudinally into association with the filler unit 27 at the filling and capping station F. The main frame section 20 also carries the capper unit 38 directly behind the filler unit 27. The frame section 20 also carries the cabinets 29 and 29*a* for the pneumatic and electric controls. A suitable cap-supply feeder 30 (FIGS. 2 and 3) may be provided behind the capper unit 28 on a separate frame 31, for orienting and feeding the valve-caps V to the capper unit 28. An additional cap-supply hopper 32 may be provided above the feeder 30.

The infeed conveyor 22, previously referred to, extends from frame extension 20*a* into frame section 20 and supplies empty containers in a single file into the machine at the loading station L. This conveyor is preferably of the table-top endless chain type and is driven continuously by an electric motor 35 supported on frame section 20. Parallel longitudinal guide bars 36 are provided at the sides of the upper horizontal run of the chain to keep the containers C in line on the conveyor. The leading container C on the infeed conveyor 22 will as shown in FIG. 2, engage with a spring actuating arm 37, carried by frame section 20 above the conveyor, which controls a conveyor-full limit valve 38 which will actuate the container crossfeed 24 to push a predetermined number of containers, as a group, off the conveyor and into association with the infeed pusher 26. The crossfeed 24 may be designed to push any suitable number as a group from the line on the conveyor 22 but, in this particular machine, five has been selected as the number in the group. The limit valve 38 is of a type which is adjustable so that several more than the preselected number of empty containers in the group of five, are required on the infeed conveyor 22, with it running in order to operate the valve.

Figure 4:
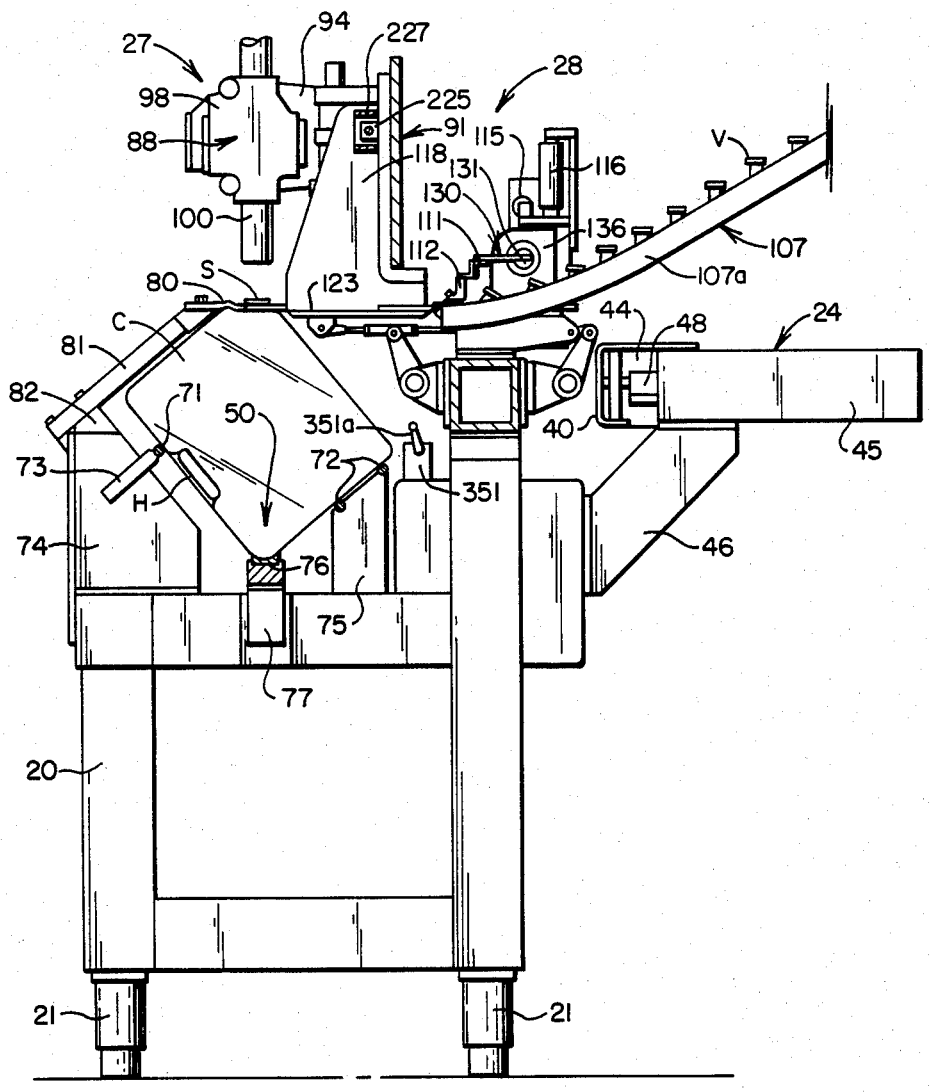
FIG. 4 is a transverse vertical sectional view taken along line 4—4 of FIG. 1.
Figure 5:
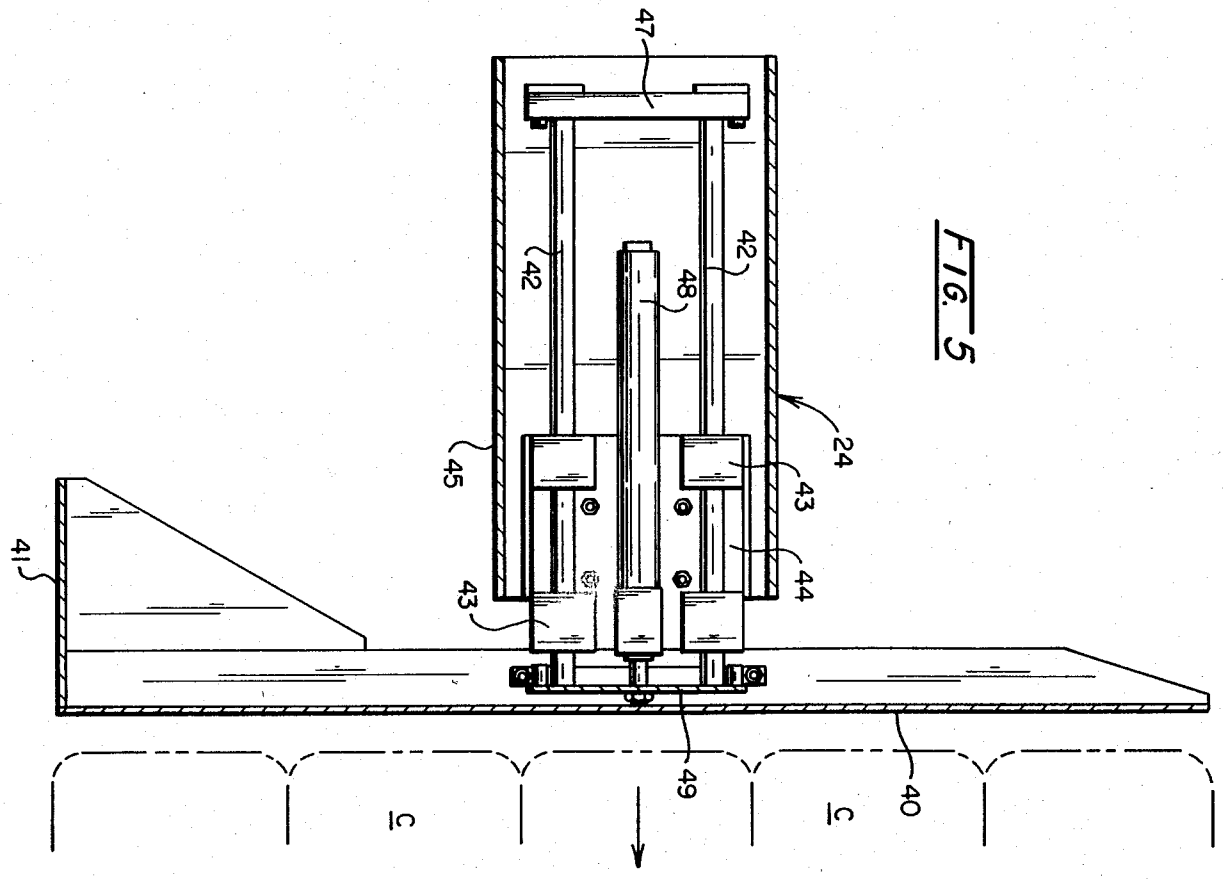
FIG. 5 is an enlarged transverse horizontal sectional view taken along line 5—5 of FIG. 3 showing the container crossfeed pusher.

The container crossfeed 24 is shown best in FIGS. 3–5 which is supported at the rear edge and above the conveyor 22 by frame section 20*a* and includes a horizontal transversely movable pusher bar 40 that is movable forwardly over and across the conveyor to push the group of five containers C forwardly therefrom. This bar 40 carries a stop shoe 41 at its rear end for engaging the forward side of the sixth container to prevent further advance of the line of containers on the moving conveyor 22 as the group of five is being swept forwardly therefrom, the conveyor merely sliding beneath the stopped containers. The bar 40 is carried on the outer ends of a pair of parallel guide rods 42 which are mounted for forward and rearward reciprocation in guide blocks 43 that are carried by a bracket 44 bolted within a box-like housing 45. The housing 45 is supported in horizontal position from the main frame 20 and is braced by an angle brace 46. Rods 47 are connected together at their rear ends by a crossbar 47. Reciprocation of the pusher bar 40 relative to the infeed conveyor 22 is accomplished by a pneumatic cylinder and piston unit 48 supported by bracket 44 within housing 45 and the piston rod of which carries a crosshead 49 that is attached to the pusher bar 40. This unit 48 is controlled by a control circuit including the conveyor-full limit valve 38 mentioned above and the valve 351. Valve control 351*a* is located so that it actuates valve 351 when the crossfeed 24 is in its most forward position (FIG. 4).

Figure 6:
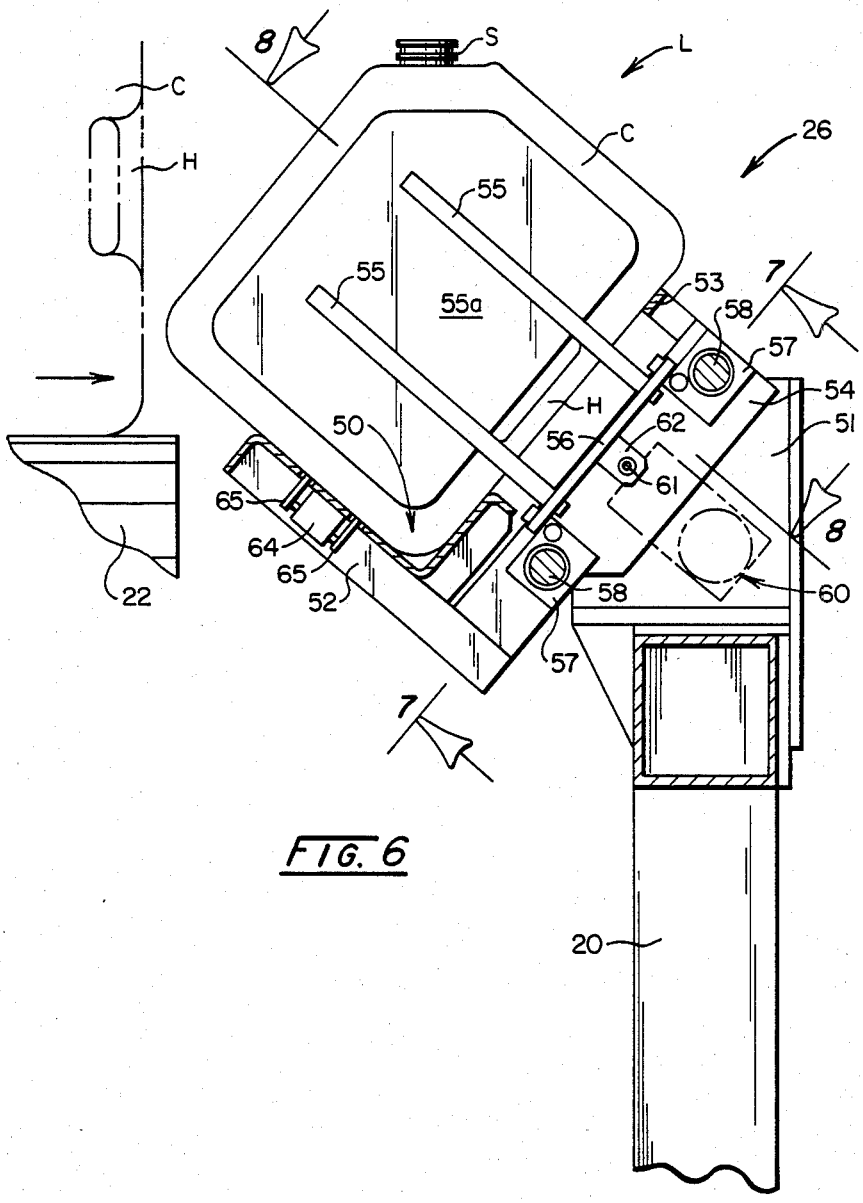
FIG. 6 is an enlarged vertical sectional view taken along line 6—6 of FIG. 1 showing the container infeed pusher.

The container crossfeed 24 moves the group of containers, five, into a horizontally disposed longitudinally extending container-orienting and supporting slide guide or trough 50 which is disposed at a level lower than the upper flight of the infeed conveyor 22 along the front of the machine and extends from the loading station L to the removal station R. This trough is of V-form in transverse vertical cross-section with its sides at right angles, so as to receive the containers C and support them with their spout S upright, as shown at the right in FIG. 3 and in FIGS. 4 and 6. This V-trough 50 is supported from the frame section 20 by means of brackets 51 and consists adjacent its infeed end of an L-shaped support and slide plate 52, which engages the oriented container at its lower corner (FIG. 6), and a support and slide bar 53, which engages it adjacent its forward and upper corner, and which are carried in parallel relationship by brackets 54 attached to brackets 51.

Figure 7:
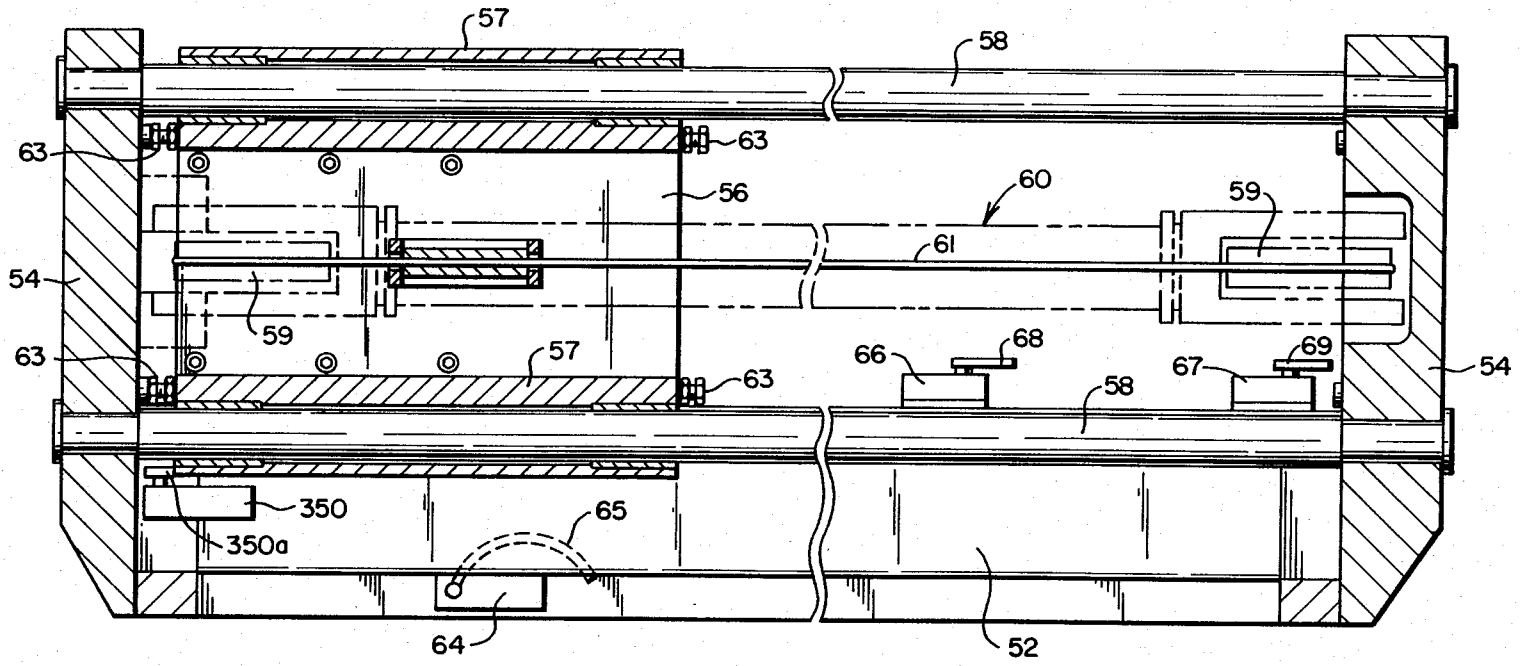
FIG. 7 is an enlarged sectional view taken along line 7—7 of FIG. 6.
Figure 8:
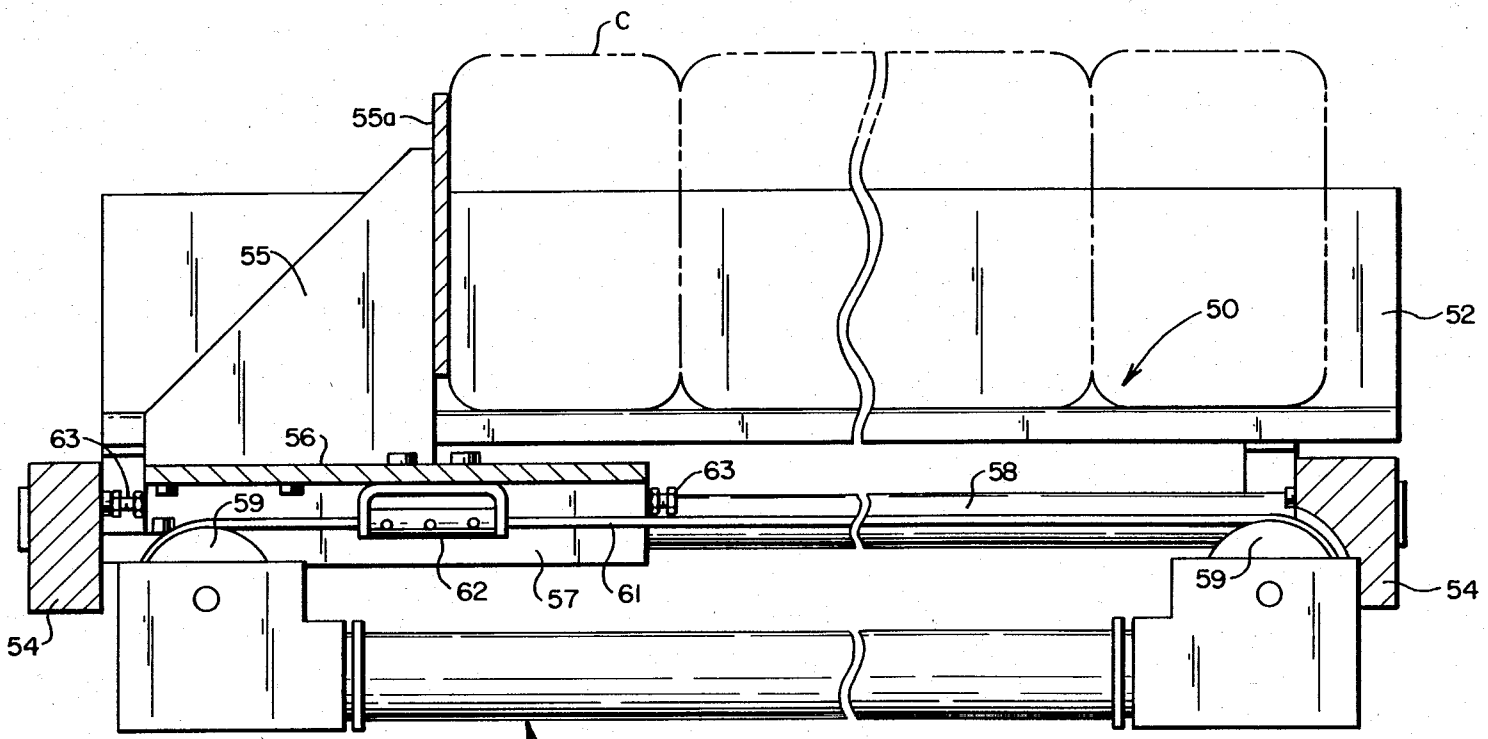
FIG. 8 is an enlarged sectional view taken along line 8—8 of FIG. 6.

The infeed pusher 26 is associated with the V-trough 50 for cooperating therewith to advance the group of containers C along the trough to the filling and capping station F. It consists of a pair of pusher arms 55 (FIGS. 6 and 8) which extend downwardly and rearwardly from pusher plate 55*a*, in spaced relationship, parallel to the side 52 of the trough, from a slide 56. This slide 56 is slidably mounted by bearing sleeves 57 on guide rods 58 which are supported in laterally-spaced relationship by the brackets 54 and extend along the trough to the filling and capping station F. The arms 55 are retracted to the rear end of the trough at the time the crossfeed pusher 24 pushes the group of containers into the V-trough, but can be advanced into the space between members 52 and 53, when it is desired to feed the group to the filling and capping station F. Reciprocation of the slide 56 is accomplished by a pneumatic cable cylinder unit 60 which is supported by the brackets 54 along the V-trough 50 and which includes the slide-moving cable 61 which passes around pulleys 59 at the ends of the cylinder and which is attached to the slide 56 by the attaching bracket 62. Adjustable stops 63 are provided at the opposed ends of the slide 56 for contact with the respective brackets 54 to accurately limit the extreme retracted and advanced positions of the slide. A trough-full limit valve 64 is actuated by a pair of spring arms 65 (FIG. 6) which are disposed on the support slide member 52 of V-trough and are located toward the rear end of the trough so they will be engaged only by the last of the five containers pushed into the trough. This valve with actuating arms 65 is carefully balanced so that the last of the empty containers in the group will activate it and it will be noted (FIG. 6) that arms 65 extend through slits at the upper and lower limits of plate 52. Limit valves 350, 66 and 67 are also provided along the V-trough and have activating arms 350*a*, 68 and 69 engaged by the containers as they are advanced. The control circuit including limit valve 350 controls cylinder unit 60 to start the action of the infeed pusher 26 to feed the group of empty containers into the filler unit 27, where they are also capped, and simultaneously pushes out the previously filled and capped group. The second limit valve 66 actuates a container stop 70 to prevent container overshoot of the unit 27 and to assist in the initial positioning of the container spouts in that unit. Valve 67 causes cylinder unit 60 to return to its original position. Valve controls 68 and 69 are precisely located on member 52 adjacent the forward bracket 54 (FIG. 7). This container-stop limit valve 66 controls the cylinder and piston 65 of the stop unit 70 which is disposed at the far side of the unit 27 (FIGS. 1 and 2) and above the V-trough 50. This unit 65 is supported in vertical position by brackets 90 attached to the frame 20 with its piston rod dependent and carrying a stop plate 67 vertically-disposed and adapted to move down between the second to the last container of the previously filled and capped group which has been pushed out by the group fed in by unit 27.

Below the filler unit 27, the V-trough 50 is formed differently as shown in FIG. 4. The sides are formed by a single front longitudinally-extending slide or guide rod 71, which engages the front or outer side of each container C adjacent its top end, and a pair of rear longitudinally-extending parallel slide guide rods 72, which engage the bottom thereof adjacent its inner side. Rod 71 is carried by brackets 73 attached to upstanding supports 75 on the central frame section 20. The rods 72 are carried by upstanding supports 75 from the frame section 20. The main support for each container C at this time is at its lower corner by means of a grooved slide track 76 carried by brackets 77 supported from the main frame section 20. The ends of members 71, 72 and 76 abut with the adjacent ends of members 52 and 53 of the inlet portion of the V. At this time also, the containers are held in the V-trough 50 by means of a longitudinally-extending neck support bar 80 which extends laterally rearwardly over the angled corners of the group of containers in the filling unit 27. This bar 80 is bolted for lateral adjustment on the upper and inner edge of rearwardly or inwardly tilted brackets 81 and extends the full length of the filler unit 27. Brackets 81 are rigidly securred at their lower ends to rigid support arms 82 which angle rearwardly and upwardly and are fastened to supports 74.

Figure 9:
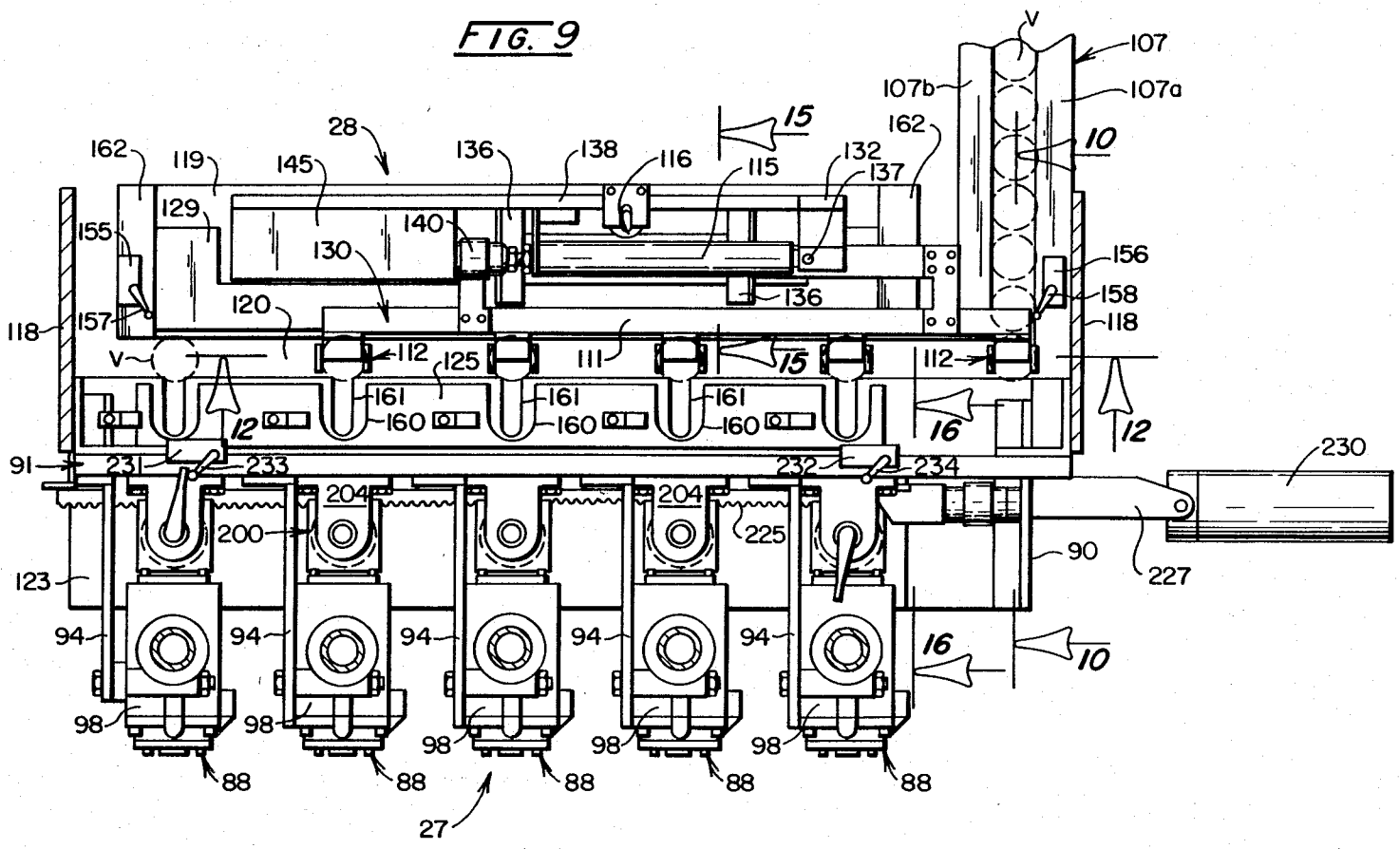
FIG. 9 is an enlarged longitudinal horizontal sectional view taken along line 10—10 of FIG. 9.

The filler unit 27 may be supplied from a supply source, such as a tank 85 (FIG. 3) by means of a product pump P. The pump is connected to the fillhead mainfold supply system including the tank 86 and connecting flexible sleeve 87 for each of the fillheads 88, in this example being five in number. These fillheads are supported at a fixed vertical position and in longitudinally spaced relationship, corresponding to the spacing of the spouts S of the group of containers at the filling and capping station F, by means of an upper longitudinally-extending horizontal plate 89 extending forwardly from a longitudinally-extending fillhead and capper support frame 91 which is upstanding from the center frame section 20 and is attached at its ends to vertically-disposed support plates 118 carried by the frame section (FIG. 9). This frame 91 includes a lower horizontal support 123. Another control-mounting plate 92 (FIG. 1) is carried by the frame 91 and may have mounted thereon certain controls 93. Each fillhead 83 is attached to the fillhead support frame section 91 by vertically-extending longitudinally-spaced parallel brackets 94 which extend forwardly from the vertical part of the frame section 91 to which they are attached.

Each fillhead 88 is controlled by its own turbine meter and preset digital electronic counter for precise fill quantity control which is indicated generally at 95. An 1" digitizing turbine meter has been found suitable.

Figure 10:
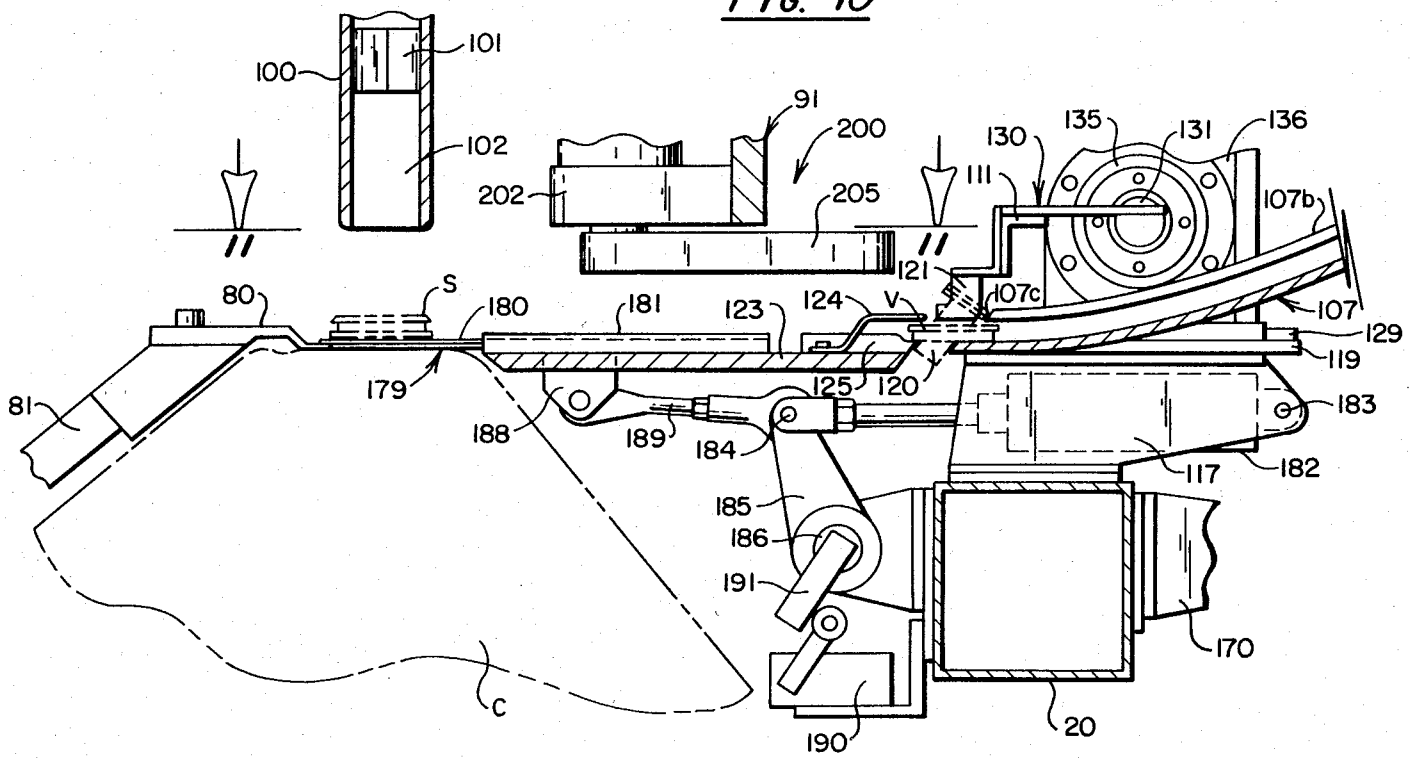

This meter has six rotor blades of a magnetic material and mounted to the side of it is a magnetic pick up generating a pulse for each roto blade passing by. Pusles are fed to an electronic predetermining four-digit counter which operates an internal relay when a predetermined count is acheived. An adjustable valve 96, preferably a gate valve, is provided for throttling the flow to the fill valve 98 of the fillhead 88. This valve may be the fast-acting ball type but other types may be used. Each fillhead includes a depending nozzle 100 which is of a type that a columnar solid stream, smaller in diameter than the container spout S, to permit escape of air from each container C during filling, is produced as indicated in FIG. 10. This nozzle may be the type which includes an internal stabilizing vane 101 and a column-forming extremity 102. A nozzle found suitable is manufactured by Spraying Systems, Inc. Alignment of the stream with the spout S is accomplished by precisely physical positioning the fillheads 88 on support 91 by their mounting brackets 94 relative to the positions of the spouts S on the containers C positioned in the V-trough 50 in filling and capping position.

As previously indicated, a suitable cap-feeder 30 may be provided for feeding the valve caps V to the capper unit 28. In FIGS. 2 and 3, this cap-feeder is illustrated as being of the round vibratory bowl type which orients and feeds valve caps single file. It includes the vibratory bowl 105 with a rheostat-controlled vibrating means 106 cooperating therewith which is set to properly vibrate the bowl and arrange the caps in a single line as it issues tangentially from the bowl 105 (FIG. 2) with the caps in the cap chut or track 107, which includes opposed channel rails 107*a* and 107*b* in which the disc-like part D first is guided and slides with the button B uppermost. A feeder found suitable is one manufactured by Moorehead Corporation, Model 83475. As the caps pass through the bowl towards an inclined part of the chute 107, they pass by a detector 108 (FIG. 2A) which will stop the feed of the caps to the inclined chute 107 if any is defective. This detector comprises an angle member 108*a*, the upper flange 108*b* of which extends radially inwardly on the bowl 105, at a slightly higher level, so it will engage a tab T of a cap if it has broken away from the button B and has swung into the broken-line position indicated in FIG. 2A. If this happens, the feed of caps V to the chute 107 will be stopped.

The cap feed system includes a demand control feature which turns the cap feeder on and off in correlation with the usuage rate of the filler unit 27 and associated capper unit 28. This demand control is comprised of detection device 110, usually photelectric or pneumatic, which is placed across the inclined cap transfer chute 107, combined with a suitable time-delay. The control detects the back-up of caps in the discharge section of the bowl feeder track, usually at the top or infeed end of the inclined transfer chute 107 between the bowl feeder and the filler unit 27. If the photo-electric or pneumatic "eye" is blanked for an extended (time delayed) period, the cap feeder will shut off, but short, intermitent blocking of individually spaced caps will be ignored by the time-delay circuit. As will later appear, another time-delay, controlled by the cap feeder detector 110 will stop the filler unit if the caps fail to feed, due to a jam-up or running out of caps, to prevent a partial supply to the cap shuttle system, a condition that is difficult to clear.

The inclined cap-feed chute 107 feeds the caps forwardly to a cap shuttle system supported by upstanding frame members 118 of frame section 20 and which includes the longitudinally reciprocable vertically oscillatable bar 111 shown in FIGS. 2, and 9–15, which carries the cap-moving flights 112 that move caps progressively from the pick-up station at the lower and forward end of the chute 107 to the respective locations directly behind each of the five fillheads 88. This shuttle system is broadly similar to the system shown in U.S. Pat. No. 4,297,929 for feeding and spacing bag spouts but is substantially modified to suit this particular application of feeding the valve caps V behind the respective fillheads 88. The shuttle bar 111 is reciprocated by a longitudinally-extending pneumatic cylinder and piston unit 115. The bar is rocked or oscillated to raise the flights 112 and returns them over the pick-up station in a square motion. Oscillation is produced by an upright pneumatic cylinder and piston unit 116. This precise square motion of horizontal and vertical movement is controlled by limit valves as will appear later.

Figure 15:
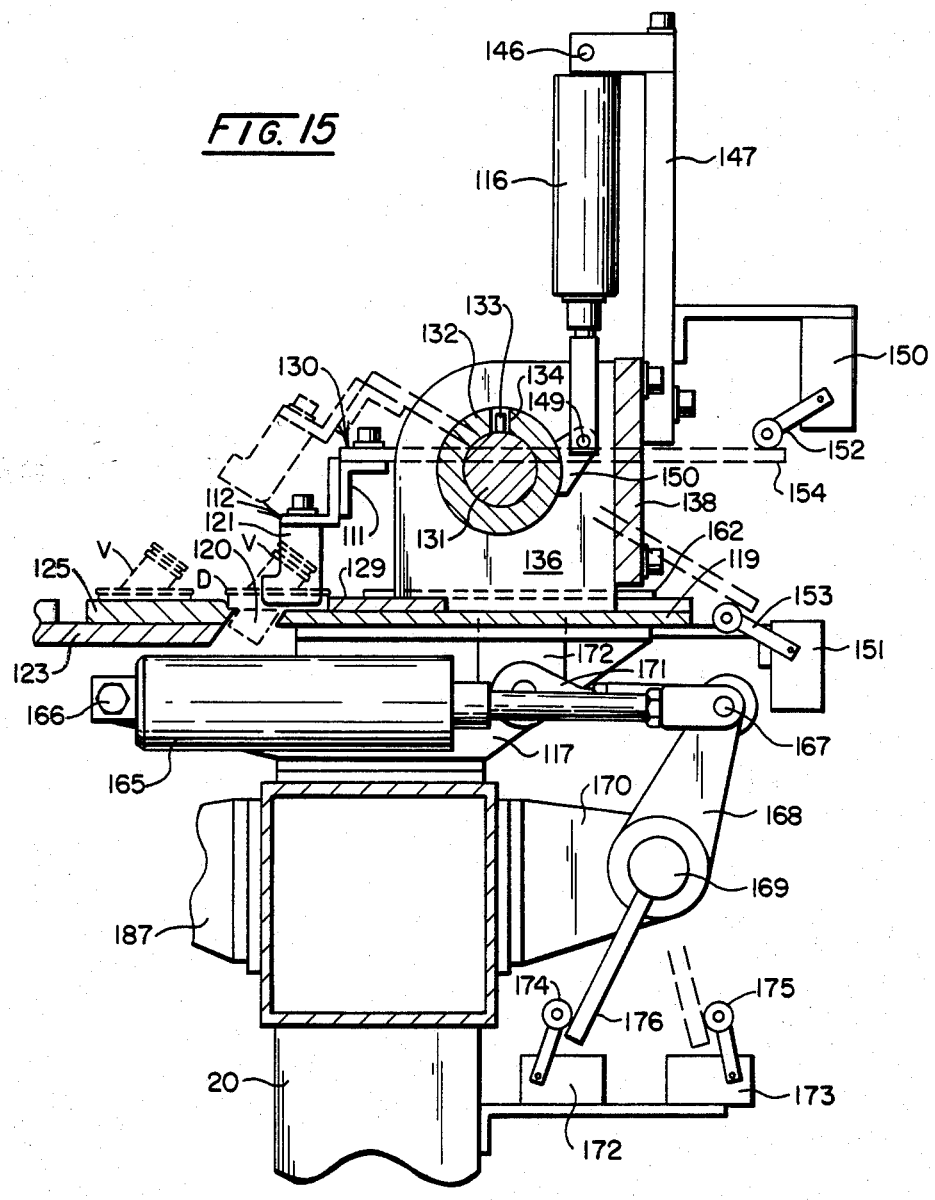
FIG. 15 is a transverse vertical sectional view taken along line 15—15 of FIG. 9.

The cap shuttle bar 111 is part of a shuttle carriage 130 which is carried by a flat support plate 119 that is supported from frame section 20 by brackets 117 (FIGS. 10 and 15). The bar 111 extends longitudinally above this plate and, directly forwardly of it, the cap shuttle track 120 is formed which has its inlet end at the lower end of cap chute 107 and extends to a point forwardly of the first fillhead 88. It will be noted from FIG. 10 that a leaf spring 124 carried by a horizontal bedplate 123 engages the lowermost cap V in the chute 107 as it enters into the track 120 to prevent its tilting as it moves into position, regardless of varying pressure and impacts from succeeding caps in chute 107 behind it. The upper corner of the chute 107 is cutaway at 116 to permit entrance of the cap-engager yoke extremity 121 of each flight 112 carried by the bar 111. The rear edge of the track 120 is formed at the forward edge of the plate 119 by it and the forward edge of a superimposed slideable cap crossfeed bar 129, and its forward edge is formed at the rear edge of a bedplate 123, carried by the vertical support members 118, and a superimposed capper-load bar 125. In the track 120, the disc-like part D of each valve will rest and slide on the track at its edges. As indicated, the shuttle bar 111 carries the flights 112 which are disposed at equally spaced longitudinally intervals corresponding to the spacing of fillheads 88 and are five in number. Each of these flights 112 is an L-shaped member depending from the shuttle bar 111 and carrying the cap-engaging yoke 121 which is of such form that it will engage and hold the cap properly oriented in vertical and horizontal planes for application to a container spout S as shown best in FIGS. 13 and 14. Each yoke 121 has forward and rearward extremities 122*a* adapted to extend to the track 120 and engage the disc-like cap part D at diametrically opposed forward and rearward points. These extremities are carried by the depending arms 122 (FIGS. 13 and 14) which engage the ends of the elongated cap button B. In addition, the top of the yoke carries a forwardly and downwardly-depending tab 122*b* that engages the front edge at the elongated button B. This three-point engagement of the yoke with the cap will hold it in the indicated position without rotation so it will be properly oriented for transfer to the capper load bar 125 to be inserted in the cap chuck 201 properly oriented for application to a spout S of the container C in the filling and capping position at the station F when the caps are subsequently moved to that station.

The shuttle bar 111 is part of a carriage 130 which is supported for transverse rocking and longitudinal movement. The carriage is supported for this movement by a longitudinally-extending slide rod 131 (FIGS. 4, 10 and 15) which is mounted for axial sliding movement in a bearing sleeve 132; the rod having a radial stop pin 133 (FIG. 15) cooperating with a longitudinal slot 134 in the sleeve to permit but limit the axial movement. Rocking movement of the rod is permitted by the sleeve 132 turning in anti-friction bearings 135 in which it is mounted at each end. These bearings are supported in brackets 136 upstanding from the plate 119 and mount the sleeve 132 parallel and above the plate 119 and rearwardly and parallel of cap shuttle track 120.

As indicated, the slide rod 131 is reciprocated longitudinally by means of the cylinder and piston unit 115 located above and in a plane parallel to sleeve 132, the cylinder of which is fastened at 137 (FIGS. 9 and 12) to a support 138 upstanding from the plate 119 which is bolted to brackets 136 (FIG. 15). The projecting piston rod 139 at the other end of the cylinder is connected, through connector 140, to the upper end of an upstanding guide arm 141 rotatably secured to the slide rod 131 at its lower end by means of a bearing 142. The upper extremity of the arm carries a guide roller 143 which operates in a guide track 144 during the reciprocation of the rod 131, and consequent logitudinal movement of the upstanding arm 141. This guide track is disposed along the upper edge support plate 145 upstanding from the support 138.

Rocking of the rod 131 relative to guide arm 141 can occur through the bearing 142 carrying the guide arm 141 on the rod. Rocking of this rod 131 and consequently, the carriage 130, is accomplished by the cylinder and piston unit 116 as previously indicated. The cylinder of this unit is pivoted at 146 (FIG. 15) in dependent position from a bracket 147 upstanding from plate 138. The lower extremity of the piston rod is pivoted at 149 to a rocker lug 150 projecting from the rear of the sleeve 132. Actuation of the cylinder and piston unit 116 will, consequently, rock the sleeve about its axis and will rock the rod 131 therewith about its axis, due to the pin and slot connection 133–134. This will raise and lower the flights 112 by rocking the carriage 130.

The carriage 180, carrying the cap shuttle bar 111, will thus be moved longitudinally by control of the cylinder and piston unit 115 and will be rocked by control of the cylinder and piston unit 116. This will advance or return all of the five flights 112 simultaneously along the cap-shuttle track 120. The first yoke 121 on the bar 111 will engage the first cap at the pick-up station at the bottom of the chute 107 and advance it a distance corresponding to the spacing between the fillheads 88, rock upwardly with other yokes to permit the return movement, which will then occur, and then rock downwardly, returning all the yokes to their original dependent positions. This will be repeated five times to successively push five caps from the pick-up station, along the cap track 120 and arrange the five caps in equally-spaced relationship, since the progressively spaced caps in the track 120, as indicated in FIG. 9, corresponding in spacing to the spacing of the fillheads 88 at the filling and capping station F will be engaged by corresponding yokes. This precise square motion of horizontal and vertical movement is controlled fully by limit valves. These limit valves include the valves 150 and 151 (FIG. 15) which have actuating arms 152 and 153, supported above and below plate 119, that are engaged upon downward rocking of the shuttle carriage 130 by a rearwardly-projecting arm 154 on the carriage. These valves actuate the cylinder and piston unit 115 to control reciprocation of the shuttle carriage. Rocking of the carriage is under the control of limit valves 155 and 156 (FIG. 9) which have actuating arms 157 and 158, and which control the cylinder and piston unit 116. Valve 155 is supported by plate 119 in a position so that its arm 157 in engaged by carriage 130 at the end of its cap-advancing stroke whereas valve 156 is supported by plate 118 in a position so it is engaged by the carriage at the end of its retracting stroke.

The delivery of five caps by the cap shuttle for each overall filling cycle is controlled by a pneumatic counter 375, for example HUMPHREY SELECT-A-COUNT, located on the main control box and which will be referred to later. This will control the number of times the shuttle bar carriage 130 can cycle.

Figure 11:
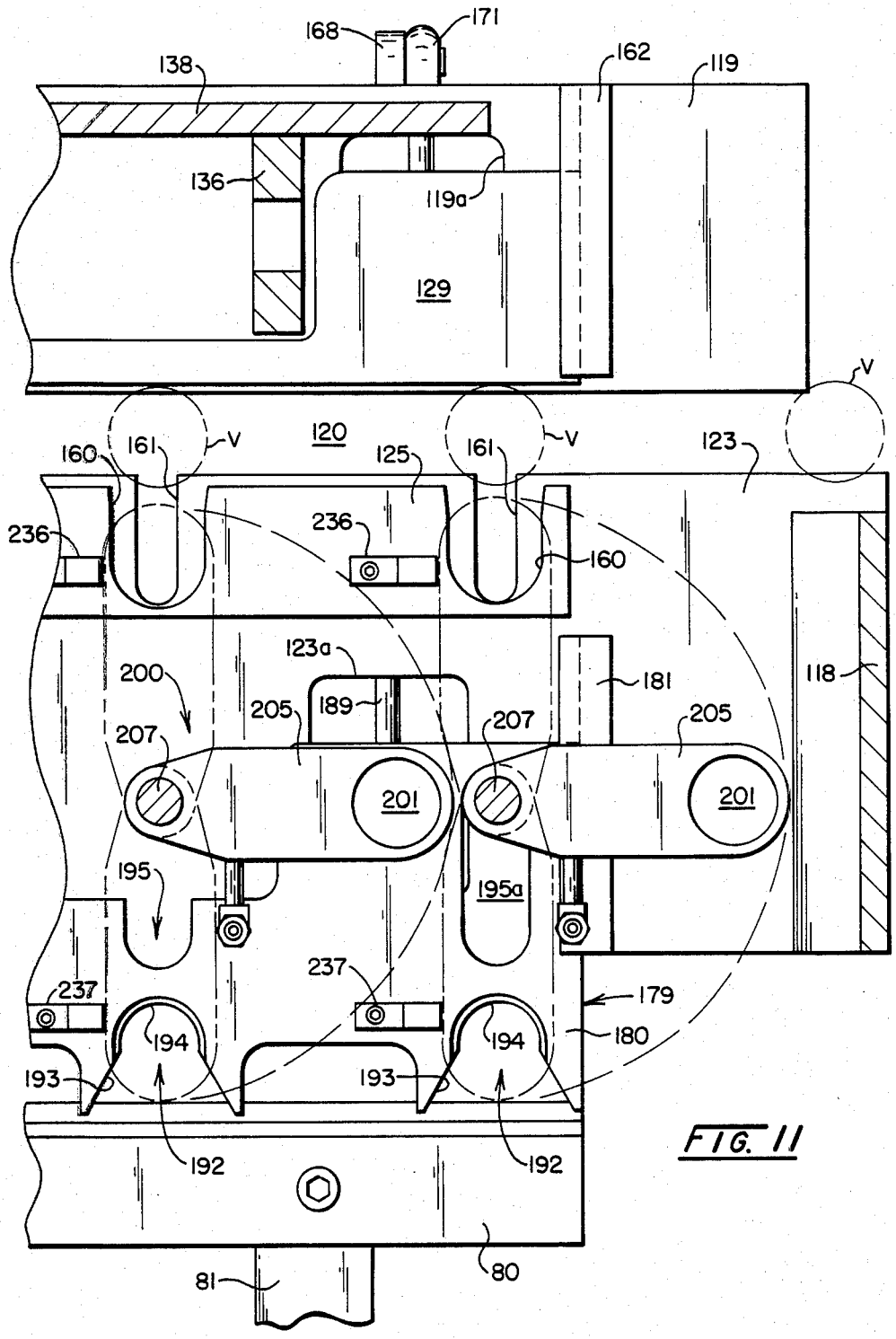
FIG. 11 is an enlarged horizontal sectional view taken along line 11—11 of FIG. 10.

The capper load bar 125, previously mentioned, has five cap-receiving notches 160 (FIGS. 9 and 11) which open rearwardly into the cap track 120. These notches are spaced longitudinally corresponding to the longitudinal spacing of the fillheads 88. Each is of a width to snugly receive the disc-like part D of the cap V. Centered below each notch 160 in the bar 125 and in the feed and latch mounting base plate 123 is a notch or slot 161 which opens rearwardly into the cap track 120 and is of a width to receive the depending tubular part of the guide G of the cap V. To move the five spaced caps V from the shuttle cap track 120 into a capper-loading position in the capper-loading sockets provided by notches 160–161, the cap crossfeed bar 129 is moved forwardly to engage and push the five caps simultaneously into those sockets. This bar 129 extends longitudinally in superimposed relationship to the plate 119 and is mounted for sliding movement relative thereto at its ends in guides 162 which are carried transversely on plate 119. To move the plate forwardly and rearwardly, a pneumatic cylinder and piston unit 165 (FIG. 15) is provided which has its cylinder pivoted at 166 and its forward end to an extension of one of the brackets 117. The piston rod extends rearwardly and is carried by upstanding crank arms 168 from a longitudinally-extending rocker support shaft 169 carried by rearwardly-extending brackets 170 attached to a main horizontal member of frame section 20. The shaft 169 is connected by bellcranks 171 through crank arms 168 to lugs 172 depending from the slide bar 129 through transverse slots **119*a* in the plate 119 (FIG. 11). Actuation of the cylinder and piston unit 165 will slide the cap crossfeed bar 129 forwardly or rearwardly relative to the support plate 119. Cylinder and piston unit 165 will by controlled by the valves 172 and 173 which are carried on the frame section 20 and have actuating arms 174 and 175 engaged by a depending arm 176 which rocks with one of the rocker arms 168**.

The five caps V are thus moved by the cap crossfeed bar 129 to the forward capper-loading position in the sockets 160–161 of the superimposed load bar 125 and plate 123 and the bar 129 is then immediately withdrawn. A spout-latch 179 including plate 180 latches five spouts S under the fillheads 88 at about the same time, movement of the bar into latching position being initiated by the infeed pusher 26 engaging the actuating arm 69 of limit valve 67, as it moves the group of five containers V into the filling and capping station F and the previously-filled containers from that station to the discharge or removal station R. This latch plate 180 is superimposed on plate 123 and extends longitudinally thereof but is mounted for transverse slideable reciprocation, as shown best in FIGS. 10 and 11. The latch plate is slideably carried by guides or grooved bearing blocks 181 disposed on the upper surface of plate 123 and in which its ends are positioned. This latch plate is moved transversely by a pneumatic cylinder and piston unit 182, the cylinder of which is disposed beneath plate 119 (FIG. 10) and is pivoted at 183 to one of the support brackets 117 attached to the center frame section 20. The piston rod thereof extends forwardly to a longitudinally-extending pivot shaft 185 which is carried by upstanding crank arms 185 from a longitudinally-extending rocker support shaft 186 carried by brackets 187 extending forwardly from a main horizontal member of frame section 20. Shaft 184 is connected to plate 180 by means of linkage 189 pivoted to lugs 188 depending through transverse slots 123*a* in plate 123 (FIG. 11). Positive latching of the spouts is indicated by limit valve 190 mounted on frame 20 which is activated by arm 191 (FIG. 10) keyed on shaft 186.

The spout latch plate 180 has five forwardly-opening spout-receiving sockets 192 in its forward edge at longitudinal intervals corresponding to the spacing of the five cap-receiving sockets 160 and 161 in the loader bar 125. Each of the sockets 192 has an outwardly-opening outer angular guide mouth 193 (FIG. 11) which converges with an inner circular spout-receiving semi-circular socket portion 194 which receives the spouts between axially spaced flanges on the spout (FIG. 10). In its rear edge, this plate 180 has three rearwardly-opening U-shaped sockets 195 formed therein which align with the corresponding three inner sockets 192, and two end forwardly and rearwardly extending slots 195*a* which align with the end sockets 192. When the latch plate 180 is moved forwardly by actuation of the cylinder 182 its forward edges overlap slightly the rear edge of bar 80. The sockets 192 of spout latch plate 80 are engaged with the spouts S and are moved into overlapping relationship (FIG. 11) with the spout-support bar 80 to grip and hold the spouts S firmly in position in precise horizontal and vertical alignment with the fill-head nozzles 100 and cappers 200.

It will be apparent from the above description that the capper unit 28 includes means for supporting and feeding five caps V to a capper-load position in the sockets 160–161 at the rear of the plate 123 and at the same time five of the containers V are clamped at the filler and capping station F forwardly thereof. Consequently, the caps must be moved subsequently from the rear load position to the forward filling and cap-application position over the spouts S of the clamped containers. This is accomplished by the capper indicated generally at 200 in FIGS. 3, 9, 11, 16, and 17. This capper has a chuck 201 which moves with a dual motion, pivoting 180° and moving vertically to pick up the cap at the precisely located rear load position and applying it at the precisely located forward apply position. The five cappers 200 are carried by frame unit 91.

Each capper 200 includes (FIGS. 16 and 17) the lower bearing member 202, the upper bearing member 203, and the intermediate bearing member 204 all of which are bolted at vertically-spaced positions to the frame unit 91. It also includes a capper chuck 201 on the outer end of a horizontal support arm 205 which extends radially from a shaft portion 207 to which it is rigidly attached. The chuck 201 has the cap-receiving socket 206 formed therein, which is so shaped that the cap will fit upwardly therewithin and be retained by friction and the disc-like part D of the cap will be engaged, upon downward movement of the chuck 201 to push the cap in the socket and subsequently onto the spout S of the container. The inner end of the radially-extending support arm 205 is connected to the lower end of the shaft section 207 precisely by a Ringfeeder locking assembly 208 which is shown as comprising two sets of locking assemblies (FIG. 17A) each of which includes two mating rings 209 and 210, the one 209 having an inside taper and the other 210 having an outside taper. When subjected to axial thrust, by tightening the lock-nut 211 on the lower end of the shaft section 207, the two surfaces mate, and additional thrust causes the two rings to deform in such a way that the inner ring contracts around the shaft and the outer ring expands the bore of the chuck. These elements provide for precise axial adjustment and adequate torque-locking to normally maintain the cap chucks 200 in precise alignment, vertically and angularly and also realign them in case of misplacement due to cap jamming. Locking assembly 208 will yield under predetermined torque stress. Between the bearings 202 and 203, a pneumatic cylinder housing 212 is axially clamped and sealed for a piston 213 to reciprocate vertically therewithin. The upper end of the shaft section 207 is non-rotatably pinned by pin and slot connection 214 to the lower end of a spline shaft 215, this lower end being vertically slideable and rotatably in the intermediate bearing 203. This shaft 215 has a vertical spline section 216, to which a pinion 217 is splined so that the shaft is free to move vertically axially therein but not to rotate relatively. This pinion is located between a lower thrust bearing 218 and an upper thrust-bearing 219. The pinion 217 has gear teeth 220 on its exposed periphery. Between the pinion 217 and the intermediate bearing 203, is a housing sleeve 221, and between it and the upper bearing sleeve 204 is a housing sleeve 222. The upper extremity of the spline shaft 215 has a reduced end 223 which can rotate and slide vertically in the upper bearing 204 but its upward movement is limited by engagement of the upper end of the spline 216 therewith.

Figure 16:
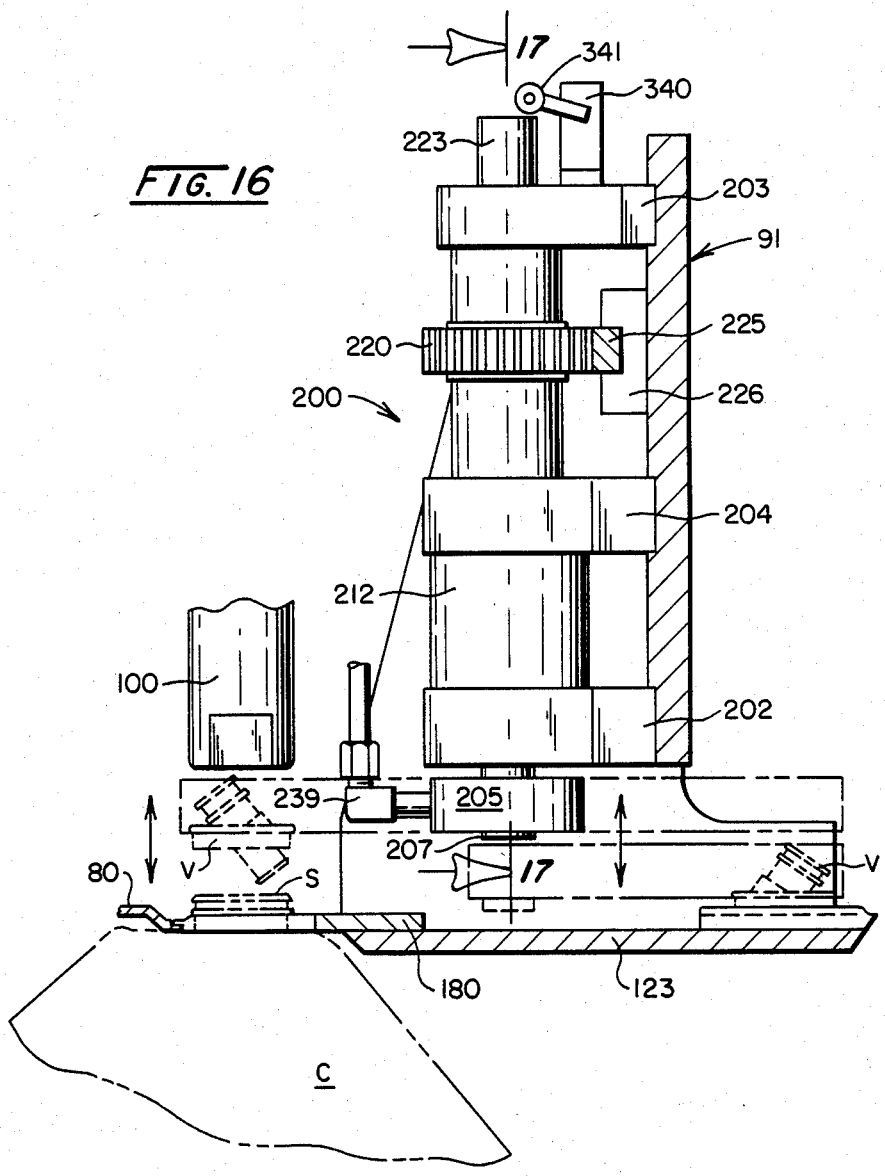
FIG. 16 is an enlarged transverse vertical sectional view taken along line 16—16 of FIG. 9.

The pinions 217 of all the cappers 200 are rocked about the respective axis simultaneously by means of a longitudinally extending rack bar 225 in engagement therewith which is shown best in FIGS. 9 and 16. This rack bar is mounted on the frame 91 in slide bearings 226 for longitudinal reciprocation. It is reciprocated by means of a pneumatic cylinder and piston unit 230 which is carried by brackets 227 bolted to the frame unit 91. This piston rod of this unit is connected to the rack bar and the unit will reciprocate the rack bar and control the limit valves 231 and 232 which have actuating arms 233 and 234. This will swing all the capper chuck-carrying arms 205 simultaneously. Vertically movement of these arms is controlled by supply and exhaust of air into and out of the cylinder 212. The vertical movement of the reduced end 233 of the spline shaft controls the limit valve 340 through actuating arm 341. Thus, by proper control, the arms 205, which carry the cap-chucks 201, are moved by combined oscillating and vertical movement from a low rear cap-loaded position to a forward low cap-apply position. Oscillation of each of the arms is limited precisely by engagement of the arm with a rear stop 236 and a forward stop 237 (FIG. 11) and this will also restore alignment. The rear stop 236 is carried on the load bar 125 adjacent its cap-receiving notch 160 and is adjustable longitudinally thereof so it can be set accurately in a precise stop position. Similarly, the forward stop 237 is carried by the latch plate 180 so that it can be adjusted in a precise stop position relative to the adjacent spout-receiving socket 192 formed in that plate.

Figures 17, 17A:
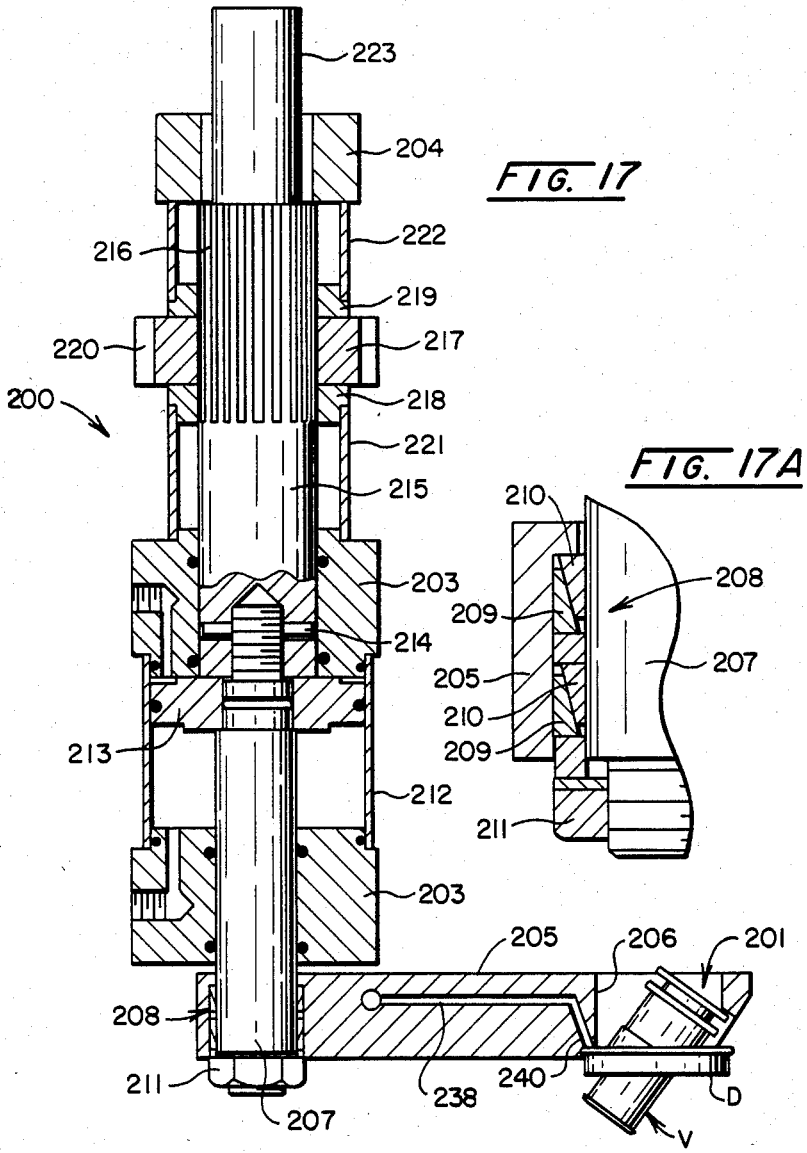
FIG. 17 is a vertical sectional view through the capper assembly taken on line 17—17 of FIG. 16.
FIG. 17A is a detail in axial section of the mounting of a cap chuck on its supporting shaft.

Each cap-chuck supporting arm 205 is provided with an inlet passage 238 which is supplied with air continuously from a connection 239 (FIG. 16). This passage leads to a sensor outlet 240 which is closed by the disc-like part D of the cap only when a cap is properly positioned in the chuck 201 as indicated in FIG. 17. This sensor serves a dual purpose i.e., detects a properly loaded chuck prior to the capping cycle and detects that the chuck is unloaded (cap applied to container) following the capping cycle.

The group of containers C which has been filled and capped is released and is then pushed from the filling and capping station F by the new group of empty containers which is pushed into that position by the infeed pusher 26. The filled group is moved onto the takeaway conveyor 23 which is like the infeed conveyor 22. This conveyor is also driven continuously, the driving motor being indicated at 255. As each filled and capped container moves from the station F, it is re-oriented to its original upright position which it had at loading with handles H forwardly, as it is positioned between side guide rails **36*b* on the continuously moving conveyor 23 when it leaves the supports 71, 72 and 76. This is accomplished by a curved rail section 71*a* which is an extension of support rod 71**.

Control Circuits

Figure 18A:
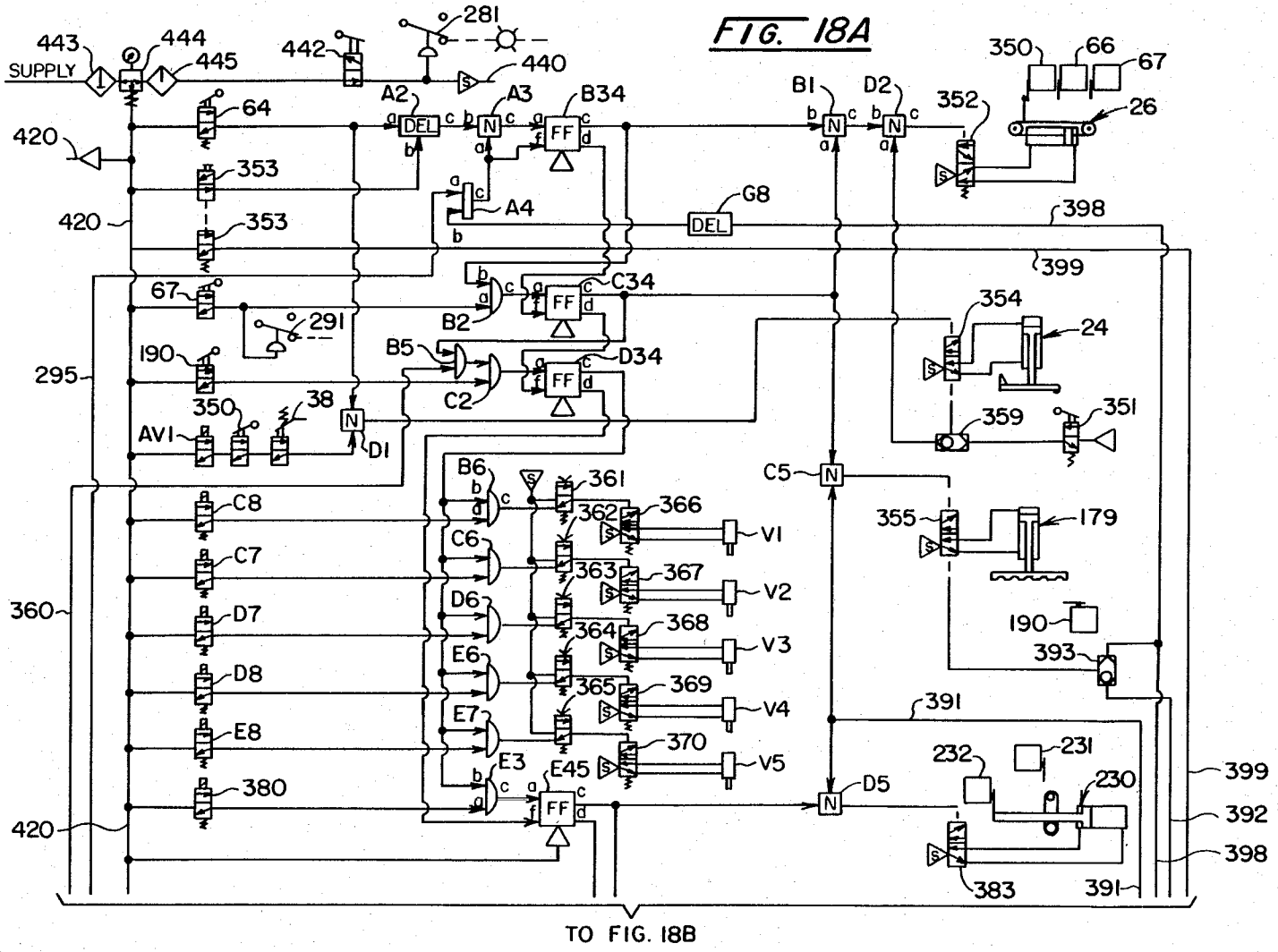
FIG. 18A is a diagram of part of the pneumatic logic system of the machine.
Figure 18B:
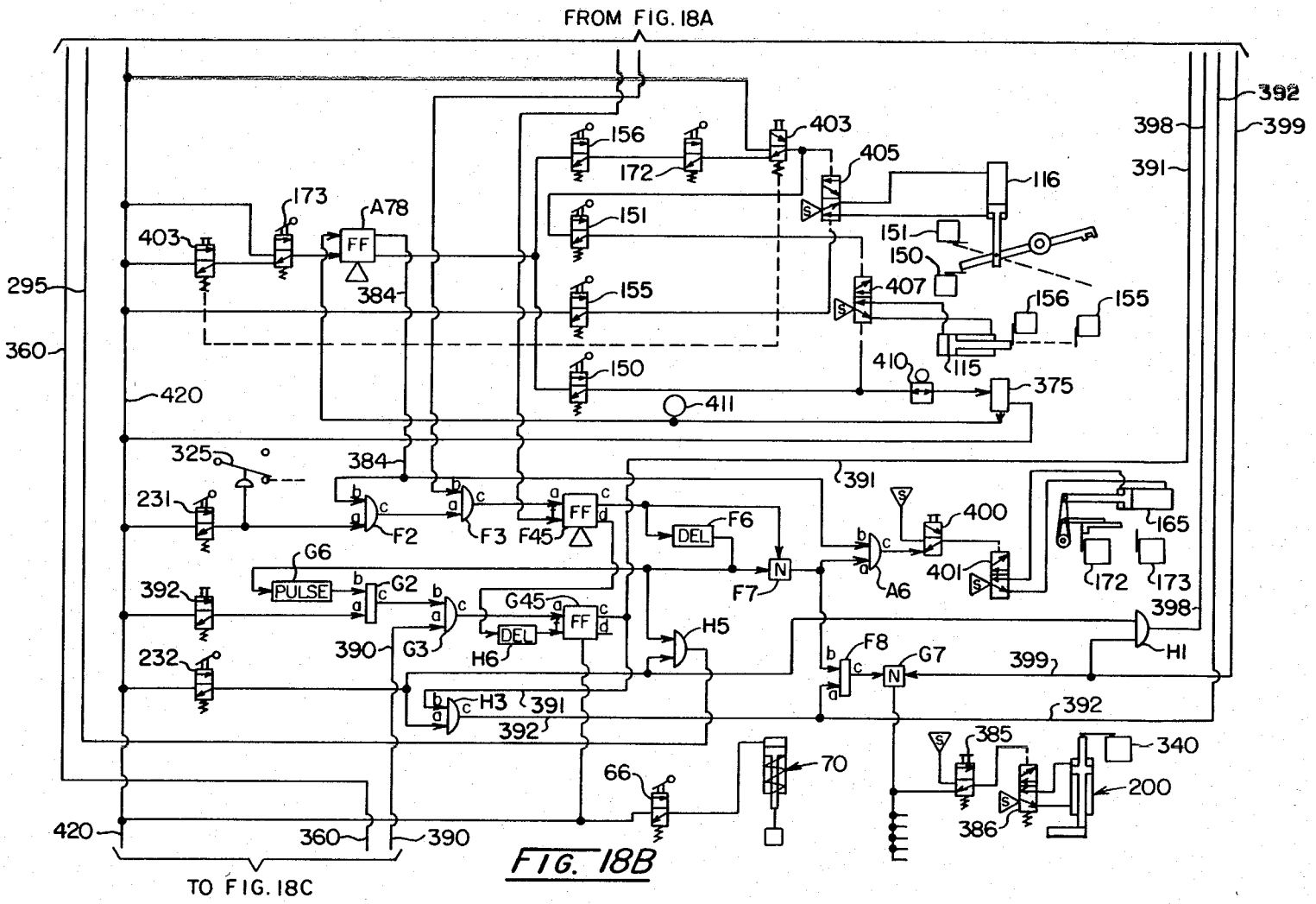
FIG. 18B is a diagram of a continuation of the pneumatic logic system of FIG. 18A.
Figure 18C:
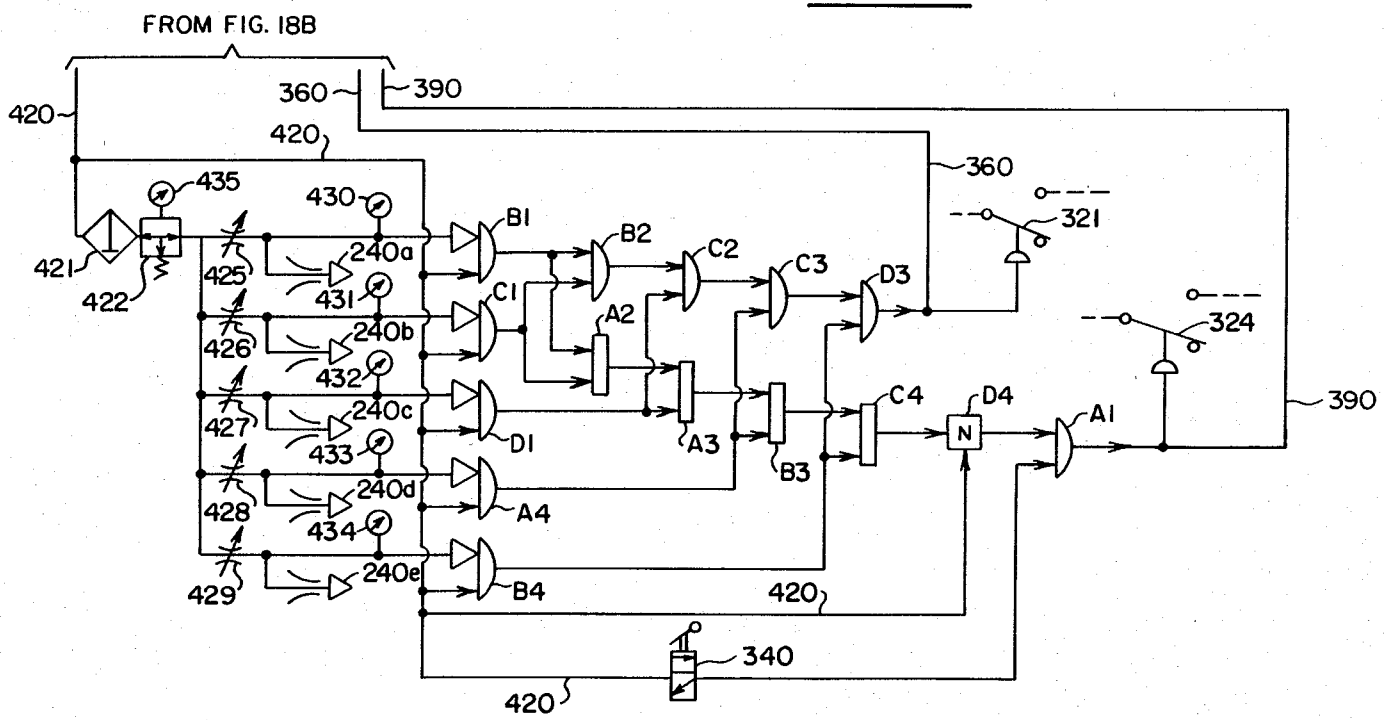
FIG. 18C is a diagram of a continuation of the logic system of FIG. 18B.
Figure 19A:
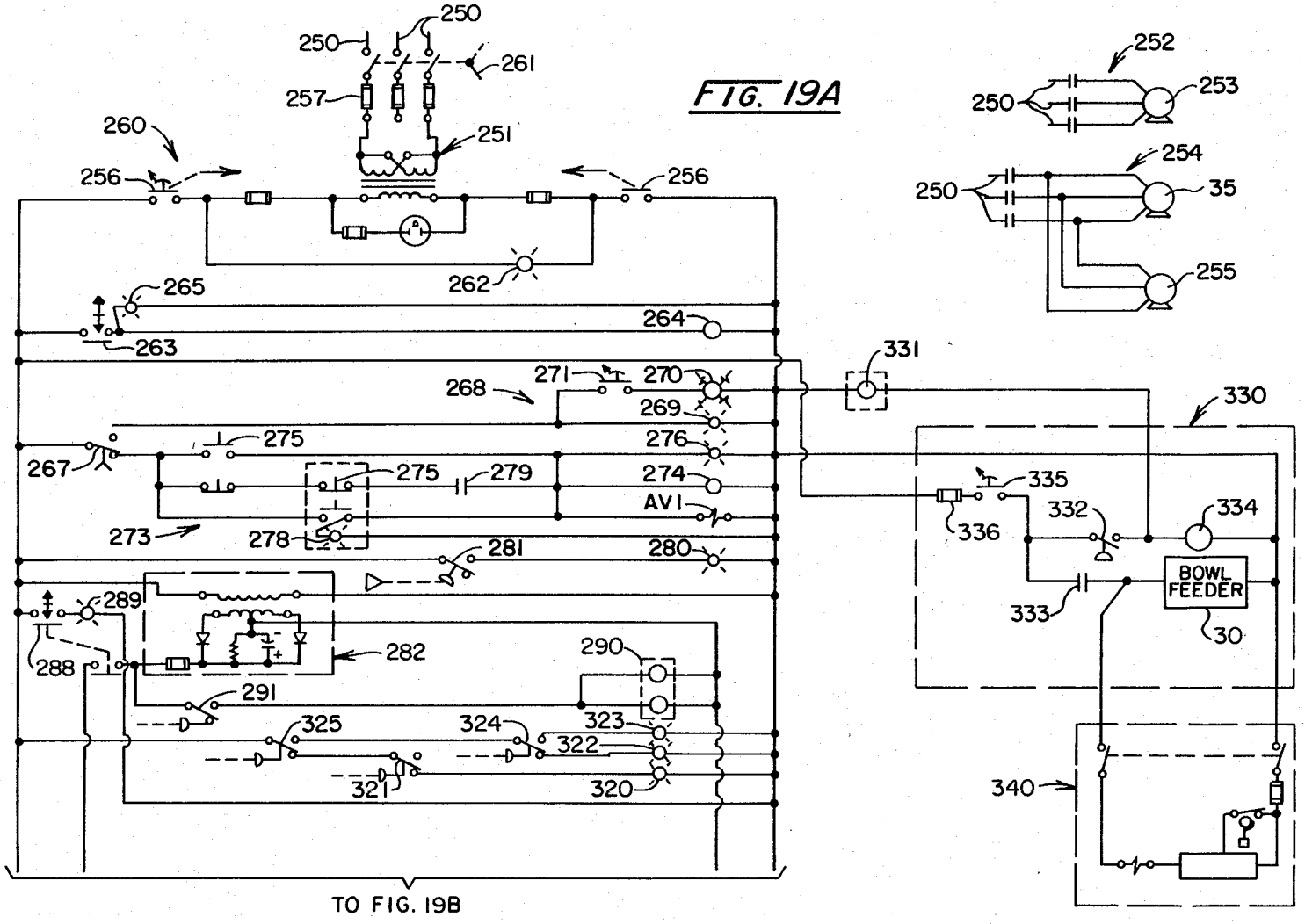
FIG. 19A is a diagram of part of the electrical circuit of the machine.
Figure 19B:
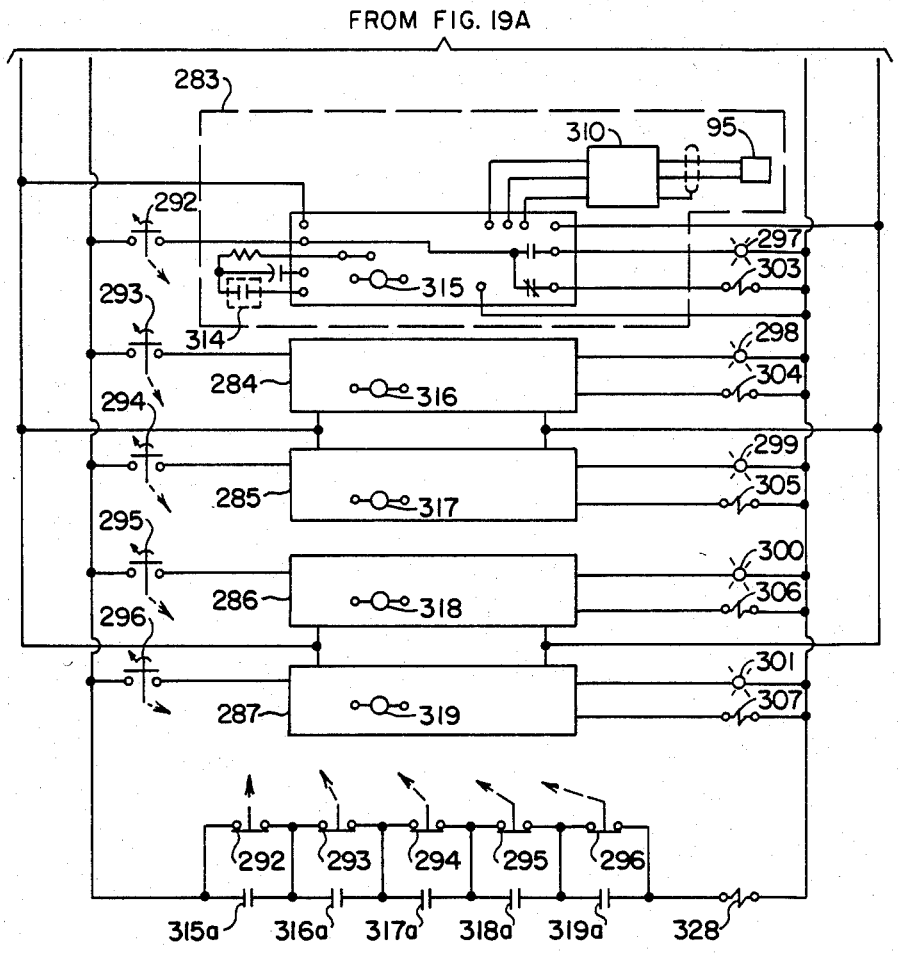
FIG. 19B is a diagram of a continuation of the electrical circuit of FIG. 19A.

A pneumatic logic control circuit for controlling operation of the in-line filling and capping machine is shown in FIG. 18A, FIG. 18B and FIG. 18C. An electrical circuit used in conjunction with the pneumatic circuit is shown in FIGS. 19A and 19B. This electrical circuit includes leads 250 (FIG. 19A) from a suitable power source, a motor circuit 252 for motor 253 which drives pump P, motor circuit 254 for motor 35 which drives infeed conveyor 22 and motor 255 which drives discharge conveyor 23. The leads 250 also connect to a step-down transformer 251, through protective circuits 257, to provide voltage for the main section 260 of the circuit on the machine, through a power disconnect at three-pole switch 261 that controls the supply of that voltage to the main on-off switch 256. The double-pole switch 256 controls reduced voltage from transformer 251. The lamp 262 indicates the power "on". Switch 263 controls moter circuit 252 through contactor 264 and is indicated "on" by lamp 265. Time-delay relay contacts controlled by delayed cap feed contactor 331 controls voltage to warning circuit 268 which indicates "no cap feed" through lamp 269 and horn 270 which can be silenced by switch 271. Contacts 267 also control voltage to circuit 273 which controls motor circuit 254 through contactor 274 and infeed pusher solenoid air-valve AVI. The double-pole start-stop switch 275 controls contactor 274 and is indicated "on" by lamp 278. The contact 279 on contactor 274 holds conveyor motors "on" and AVI "on" when double-pole switch 275 "start" is pushed and released. When "stop" is pushed conveyor motors and AVI are turned "off". Lamp 280 indicates "no air pressure" through switch 281. The main circuit 260 also includes a low-voltage power supply 282, controlled by a double-pole switch 288 and indicated "on" by lamp 289, of a suitable type which supplies a voltage for counter 283, 284, 285, 286 and 287 (FIG. 19B) which can be of various commercially available types such as the count/control manufactured by Durant Digital Instruments. Low voltage power supply 282 operates solenoid air valves 303, 304, 305, 306 and 307 under control of interval relay contacts of the respective counters 283, 284, 285, 286 and 287. The counters are reset by a contactor 290 that is controlled by air-operated reset switch 291 and its auxiliary relays 290. Double-pole switches 292, 293, 294, 295 and 296 control supply voltage to the counters. Turning switch 292 to the "off" position closes the by-pass contacts 292 thereby permitting the filler unit 27 to operate with the first head 88 mal-functioning. "Fill complete" of each container is indicated by lamps 297, 298, 299, 300 and 301. The solenoid air valves 303, 304, 305, 306 and 307 control the flow of liquid through the respective fill-heads 88 by controlling solenoid air valves V1, V2, V3, V4 and V5 (FIG. 18A). Only counter 283 will be described, since counters 284, 285, 286 and 287 operate the same as 283. Connected to the counter 283 to provide an input signal thereto is the signal conditioner 310.

The signal conditioner is also of a common type one source also being Durant Digital Instruments. The signal conditioner 310 received input from a digitizing flow meter 95 of a common type which provides a signal in accordance with the volume of liquid flowing therethrough. The volume flow meter used may be of the turbine type oscillating piston type, or electronic type. As indicated, one type found very suitable is the turbine type known as "Invalco 1" Digitizing Turbine Meter. One of these flow meters 95 is interposed in each liquid supply line which supplies liquid to the respective fillheads 88. Contact 314 of relays 290 and 293 resets counter. Contacts **315*a*, 316*a*, 317*a*, 318*a*, and 319*a* of counters 283, 284, 285, 286, and 287** and close when fill is complete.

Solenoid air valve 328 controls the capper pivot cylinder 230 and is controlled by contacts **315*a*, 316*a*, 317*a*, 318*a* and 319*a*. The double-pole switches 292, 293, 294, 295 and 296 by-pass contacts 315*a*, 316*a*, 317*a*, 318*a* and 319*a*** when the switch is in the "off" position.

Lamp 320 (FIG. 20) indicates cap chucks "not loaded", through switch 321. Lamp 322 indicates caps "not applied", through switches 324 and 325. Circuit 330 (FIG. **19*a*) controls the cap feeder 30. Cap delay relay 331 indicated "delayed cap feed" through switch 267, and through switch 332 of circuit 330 controlled by the cap detector unit 110. Contacts 333 of contactor 334 are also controlled by switch 332 and turn on the cap feeder 30 when caps are needed. Switch 335 controls power to circuit 330 through protector 336. Circuit 340 controls the hopper 32 to maintain a proper level of caps in the bowl feeder. The bowl feeder is mechanically-tuned vibratuary feeder system which works best with a predetermined mass (weight) of caps in it. A paddle type level detector switch (not shown) is suspended in the bowl to control discharge of caps. An electro magnet (not shown) is an integral part of the hopper 32** and is energized to feed caps into the bowl.

A. Esssentially , the complete loading, filling, capping and unloading operation is controlled as follows:

1. Containers C are loaded in loading station L by conveyor 22;
2. Containers C are pushed by crossfeed 24 forwardly onto trough 50;
3. Containers C are pushed by infeed-pusher 26 to capping and filling station F;
4. Containers C are filled and capped;
5. Containers C are pushed by infeed-pusher 26 and five empty containers to removal station R; and 6. Containers C are removed by discharge conveyor 23.

Specifically referring to the logic control system;

1. Compressed air to the machine is separated into lubricated and non-lubricated branches 440 and 420 through filter 443, regulator 444 and lubricator 445. Lubricated air 440 supplies all air cylinders. Non-lubricated air 420 supplies the logic system. A hand lever operated air shut-off and exhaust valve 442 is mounted on the machine in a suitable location. It cuts off the air to all mechanisms, and exhausts it so that those mechanisms can be moved manually for set-up purposes or in clearing jams. Normally, the air is uninterrupted to the logic system. With this arrangement, a cycle can be interrupted to clear a jam, and when restored will continue without re-setting to its starting point. This is desirable to prevent a subsequent jam up following the clearing of one.

2. Referring to the drawings, it will be noted that lubricated air is shown by the symbol and non-lubricated air to the logic comes off air line 420. The following outlines the major portion of a complete cycle and assumes the preceeding cycle is complete, i.e., air logic *reset* has occurred and the reset line 295 is pressurized. In the first part of the following description, the ports of the AND, OR, NOT, FLIP-FLOP, etc., units are designated but later these designations are not used as they are understood. Pressure on line 295 passes through OR unit A4. OR A4 can also receive pressure through AND HI through line 398 AND DELAY G8. AND HI also received pressure from capper pivot valve 232 and auto stop valve 353, through line 399, when auto stop valve 353 is pushed into the stop position. The input to A4 is port a and the output is port c. Port c of A4 pressurizes port a of NOT A3 to shut if off, thus removing air pressure from port a of FLIP-FLOP B34, thereby exhausting port c of B34 and removing pressure from downstream units, NOT B1 and NOT D2. Reset pressure through A4 is applied to port f of FLIP-FLOP B34 which no longer has pressure on port a, as previously described, and FLIP-FLOP B34 shifts to pass pressure to d port of B34. Pressure from d port is applied to f port of FLIP-FLOP C34, shifting it to pass air from its a port to the f port of FLIP-FLOP D34, shifting it to pass air from its d port to the f port of FLIP-FLOP E45, shifting it to pass air from its d port to the f port of FLIP-FLOP F45, shifting it to pass air from its d port to DELAY H6, and then on to pressurize port f of FLIP-FLOP G45, shifting it to pass air to its port d which is plugged, thus ending the resetting of the entire FLIP-FLOP "chain". Construction of the FLIP-FLOP units is such that only one of the control ports a or f can be pressurized at a time in order for the FLIP-FLOP to shift, similar to a condition relating to shifting of a conventional 4-way spool valve by pressurizing only one of the pilot lines.

The removal of air from ports a of the above described "chain" of FLIP-FLOPS will be described in the following circuit explanation. It will be noted that the resetting occurs serially in rapid sequence as reset line 295 is pressurized.

3. A cycle may be said to commence when empty containers c accumulate against the conveyor-full limit valve 38 which is spring-loaded and requires more than five containers to operate. Assuming the cap supply is adequate and infeed pusher 26 is retracted, valves AVI and 350 are passing air to valve 38. Air passes through NOT unit D1, shifting double piloted 4-way valve 554 to operate the bottle crossfeed pusher 24. Valve 351 is activated when container crossfeed 24 reaches its forward position, causing valve 354, through 359, to return crossfeed 24 to its original position. If trough 50 is full, the empty container in the last position in the trough operates valve 64, pressurizing NOT D1 which shuts off air to spring-return valve 354, controlling the crossfeed pusher 24 causing the pusher to retract. Air pressure from valve 64 also supplies DELAY A2 allowing containers to settle in the trough, then through NOT unit A3, b to c ports, and FLIP-FLOP B34, a to c ports, and NOT units B1, b to c ports, and D2, b to c ports, thus to operate infeed pusher 26 shifting spring-return 4-way valve 352. The infeed pusher cylinder operates limit valve 67. Valve 67 actuates pressure switch 291, resetting the counters 283–287 to 0. Pressure is also supplied to port a of AND amplifier B2, and b port of which is supplied from the c port of FLIP-FLOP B34. Output c of B2 supplies the a port of FLIP-FLOP C34 to shift FLIP-FLOP C34. Output at port c from C34 shuts off NOT unit B1 to return the container infeed pusher 26, and supplies air through NOT C5 to spout latch 179 through valve 355. The output from C34 also supplies AND amplifier B5. The spout latch 179 operates limit valve 190, supplying air to AND unit C2. Air through C2 shifts FLIP-FLOP D34, supplying ports b of AND units B6, C6, D6, E6, E7, and E8. The five AND units B6 through E7 open the fill valves V1, V2, V3, V4, and V5 through valves 361–365, 366–370 if counters 283–287 have been reset energizing solenoids C8, C7, D7, D8, and E8 which supply ports a of B6 through E7.

4. AND B5 is supplied from line 360 when all chucks 201 are loaded and all sensors **240*a*–240*e* are made and if circuits have been reset. Output from B5 supplies AND C2. C2 is supplied if spout-latched limit valve 190** is operated. Thus fill will not take place unless the above conditions exist, including properly-latched spouts.

5. On completion of fill, electrical relay contacts in the electronic counters operate to denergize solenoids C8, C7, D7, D8 and E8 and close fill valves V1–V5. Also solenoid 380 energizes supplying port a of AND E3 whose output c shifts FLIP-FLOP E45 to start the capping cycle. The output from E45 supplies NOT D5 passing air pressure to spring-return four-way valve 383 causing the capper pivot cylinder 230 to pivot cap chucks 201 forward. When forward, limit valve 231 supplies port a of AND F2. Port b of F2 has an input when the cap counter 375 counts out through FLIP-FLOP A78 through line 384. The output of A78 also supplies port b of AND A6. Port a of A6 has an input from F45 through DELAY F6 and NOT F7. The output from A6 shifts 4-2way valve 401 through normally-open ports of push-button valve 400. Therefore, caps crossfeed by unit 165 when cappers 200 are pivoted forward. F7 also supplies port a of OR unit F8. The output of F8 supplies NOT G7 to 4-way spring-return valve 386 through the normally-open push-button valve 385 to lower cappers 200 to apply caps V to containers C. Cappers 200 are returned upward and the crossfeed 165 is retracted when DELAY F6 times-out to shut-off NOT F7. FLIP-FLOP A78 is shifted by the cap crossfeed forward valve 173 and supplies valves 156 and 150. FLIP-FLOP A78 can also be shifted by valve 403. Valve 156 is activated when the cap shuttle bar 111 of carriage 130 is returned over its pick-up station, causing the cylinder 116 to swing the cap shuttle bar 111 down, through valves 405, 403 and 172. The valve 403 previously mentioned also causes cylinder 116 to be actuated to cause the cap shuttle bar to start a cycle. The valve 172 is activated when the cap crossfeed 129 returns. Valve 151 is activated when cylinder 116 moves the shuttle bar down, causing cylinder 115 to extend the cap shuttle bar horizontally, by means of valve 407. Valve 155 is activated when cylinder 115 is extended, causing cylinder 116 to retract upwardly, through valve 405. Valve 150 is activated when cylinder 116 retracts upwardly, causing cylinder 115 to return and also causing counter 375 through regulator 410 to count. Also when cylinder 115 returns, it activates 156 starting a new cycle of the cap shuttle. After the cap shuttle cycles five times, the counter 375 completes its count and shifts FLIP-FLOP A78 through volume chamber 411 stopping the cap shuttle and supplying line 384 previously mentioned.

6. The delayed output from F6 also supplies pulse G6 whose output supplies the b port of OR unit G2. G2 output supplies port b of AND G3. Port a of G3 has a signal through line 390 if all caps have been applied (chucks 201 not loaded), and if cappers 200 are up to activate valve 340 to produce an output from AND A1 to the input a of AND G3 through hue 390. G3 output shifts FLIP-FLOP G45 whose output shuts off NOT unit D5 through line 391 allowing valve 383 to shift back to pivot cappers 200. Output from G3 also shuts off NOT C5 through line 391 to 4-way valve 355 controlling the spout latch 179. When the cappers 200 are pivoted back, limit valve 232 retracts the spout latch 179 by supplying a signal through AND H3 to line 392. Pressure on line 391 shifts shuttle valve 393 to shift valve 355 to the spout latch 179.

7. Cap crossfeed 165 operates when the cappers 200 are pivoted forward, opening limit valve 231 which passes air through AND amplifiers F2 and F3 and FLIP-FLOP F45 and the NOT F7 to the port a of AND unit A6. The b port of AND unit A6 is supplied through the FLIP-FLOP A78 as explained above. The output from A6 activates valve 40 to operate the crossfeed caps pusher 165 until it operates limit valve 173 to shift FLIP-FLOP A78 shutting off b port of A6 exhausting its output to the following circuit as described above and returning cap crossfeed. Caps V are applied when the cappers 200 are pivoted forward, opening limit valve 231 supplying in series AND F2, AND F3, FLIP-FLOP F45 and NOT F7 to the a port of OR unit F8 and through NOT G7. The output port c of G7 supplies five identical circuits to the five cappers 200. Each circuit includes a push-button valve such as 385 and assorted spring-return 4-way valves such as 386. Cap-apply pistons 213 are pressurized downward until delay F6 times-out, shutting-off NOT unit F7 and removing supply air from OR unit F8 and NOT G7. Pistons 213 raise at the end of F6 delay interval, operating limit valve 340, putting a signal into the a port of AND amplifier A1. The b port of A1 is supplied a signal if all cap chucks 201 have been unloaded uncovering all sensors 240*a*–240*e*. Output from c port of A4 supplies port a of AND amplifier G3 through line 380 to shift FLIP-FLOP G45. Port c output from G45 shuts off NOT unit D5 causing pivot cylinder 230 to rotate cappers 200 back over cap-loading position. If one or more chucks 201 remains loaded, (container(s) not capped), the cycle stops and the pulse signal from G6 is lost. This allows an operator to clear the chuck safely as the cycle will not continue until the Resume button 392 is pressed , supplying port a of OR unit G2. Output from G45 also supplies b port of AND unit H3. Port a of H3 gets signal from cappers pivoted back limit valve 232. Output from H3 supplies b port of OR unit F8. Output from F8 supplies NOT unit G7 to lower cappers 200 over loading stations to pick up caps V. Limit valve 232 also supplies port a of AND unit H5. Output from H5 resets FLIP-FLOPS starting with B34 and continuing through the chain C34, D34, E45, F45 and G45 as previously described. Resetting of G45 is delayed by DELAY unit H6. When reset, G45 loses output from c port shutting off output of AND unit H3 and shutting off output of OR unit F8 and AND unit G7 to raise cappers 200 to standby position ending the cycle.

As previously stated circuits controlled by cap sponsors 240*a*–240*e* function twice in a complete filling-capping cycle. The first function detects that all cap chucks 201 are loaded (air jets closed) and stops the machine if one or more chucks are not loaded. The second function detects that all chucks 201 are empty (caps V are applied to containers C) and stops the machine if one or more are loaded. The circuits accomplishing this include:

(1) amplified input AND units B1, C1, D1, A4 and B4.
(2) AND units B2, C2, C3, D3, A4
(3) OR units A2, A3, B3, C4
(4) NOT unit D4

Indication of these functions are by the lamps 320, 322 and 323 in the electrical circuit 260. Lamp 320 controlled by switch 321 and 325 is "on" when valve 231 and line 360 are not made. Lamp 322 controlled by switch 324 and 325 is "on" when valve 321 is activated and line 390 has no input. Lamp 323 controlled by switch 324 and 325 in "on" when vavle 321 and line 390 are activated. Amplified AND units have one input connected to the logic supply air pressure 420. The other input includes an amplifier that is adjustable to detect a small change in air pressure as is produced when a cap V closes off an orifice (sensor jet) in the cap chuck 201 or when a cap is removed to open the orifice. If all chucks 201 are loaded, all amplified AND units pass air pressure through AND units B2, C2, C3, D3, to produce an output on line No. 360 which supplies AND B5. Additionally, each amplified AND unit supplies air to its associated OR unit, i.e, A2, A3, B3 or C4. If any chuck 201 is not loaded, its associated amplified AND unit will not pass air pressure to the OR unit to which it is connected, i.e, A2, A3, B3 or E4. Thus, that OR unit will not be pressurized and there will be no output from OR C4, thus no input to NOT D4 to shut if off. AND A1 will, therefore, have inputs to produce an output pressure at to line 390. Lacking pressure on line 390 stops the machine as there is no input to AND 63 and thus there is no signal to shift FLIP-FLOP 645. The cappers 200 therefore remain pivoted to the back over the chuck-loading station until all cap chucks 201 are loaded.

The cap sensors 240*a* through 240*e* are supplied through filter 421, regulator 422, to adjustable fixed restrictions 425, 426, 427, 428 and 429. There are six pressure gauges 430, 431, 432, 433, 434 and 435 inside the main control box, five of which indicate back pressure, or lack of it, depending on whether or not caps are properly placed in the chucks 201. Also they provide indication for adjustment of the sensor system sensitivity through restrictions 425, 426, 427, 428, and 429. A sixth gauge 435 shown supply air pressure to the sensors.

Figure 20:
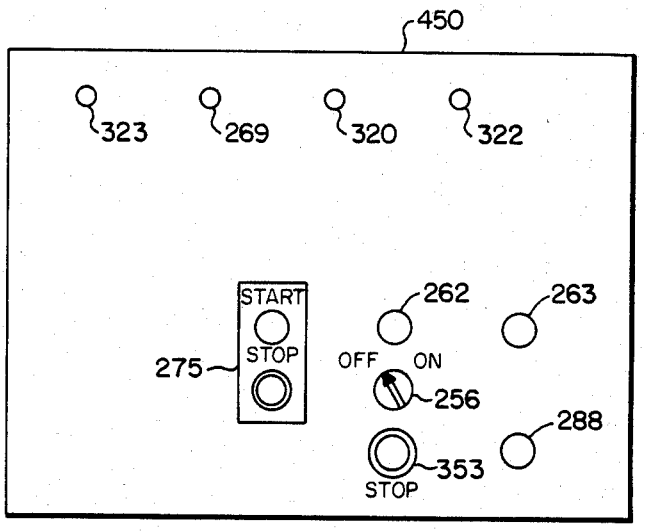
FIG. 20 is a schematic illustration of the main operator control panel.
Figure 21:
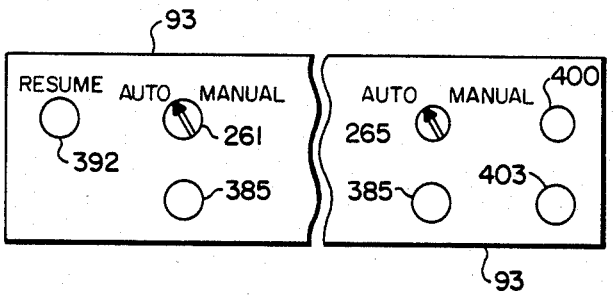
FIG. 21 is a schematic view of the individual fillhead control panel.

The following control push buttons and selector switches (electrical or air valve) are provided on panels 450 and 93 shown in FIGS. 20 and 21.

Start-Stop 275. Illumminated push button station. Provides the normal means for starting or stopping the machine. Stops conveyors 22 and 23 and locks out crossfeed 24 and infeed pushers 26.

Power on Pilot Light 262. Indicates main supply power is on. Controlled by main disconnect switch 261 interlocked with door of back electrical cabinet.

120 V. AC. Off-on selector switch 256. Controls all 120 V. AC power to the machine.

Push to Stop, Rotate Collar to Start, air valve 353. For emergency use only. Resets pneumatic system. Returns mechanisms, except capper 200 pivoting and unlatch 180 if machine has stopped due to cap(s) V not applied. After removing the cap(s) V from chuck(s) 201 press resume botton 392 (valve must first be released by turning collar clockwise).

Pump illuminated push-pull switch 263. Starts and stops pump. Controls 3-phase motor starter in back electrical cabinet.

Fill Master. Illuminated push-pull switch 288. For emergency use. Stops fill by closing all fill valves. Locks out capping circuit.

Condition Lights 269, 320, 322 and 323. Inform operator of cause of machine stoppage.

Individual Fill Head Controls. Associated with the heads 88 are selector valves 261, 262, 263, 264 and 265, and a push button valve 385 for each. With the selector to manual, fill valve stays open for rinsing the system or may be used for topping off partially filled container c during set up.

The manual capper down push button valve 385 controls the up-down stroke of its associated capper 200. It is useful on start-up as a means of loading cap chucks 201, and for capping containers manually following a malfunction. It is useful also in checking capper to container alignment.

Resume push button 392 is pressed when cap chucks 201 are forward to resume machine cycle following the clearing of a cap from a chuck. Eliminates the hazard of cycle continuing instantly as cap is removed, and the possibility of catching an attendant's fingers.

Crossfeed Caps and Shuttle Five push button valve 400. Useful on start up. Cycles crossfeed bar 125 and shuttle 111 to count and place 5 caps.

Shuttle Five Caps Only push button Valve 403. Cycles shuttle 111 to place five caps.

It will be apparent from the above description and the accompanying drawings that the machine of this invention is an in-line machine which accommodates a cube-shaped, space-efficient, nearly-zero, head-space container, receiving it in its normal prior art container-capping mode. However, in this machine the neck or spout of the container is gripped and the container is supported in a manner to permit application of a high-force snap-cap. This particular machine fills and caps containers without moving the fillhead or the container but could be adapted to subsurface filling by relatively moving them. The machine is designed to have high capacity by receiving groups of the containers, re-orienting, filling and capping the containers of each successive group simultaneously, and then again re-orienting them for discharge.

We claim:

1. A machine for filling and capping containers comprising an infeed conveyor for supplying containers to an infeed position which includes a container crossfeed mounted in cooperation with said infeed conveyor to move a group of containers of predetermined number off the infeed conveyor, a container guide mounted along the infeed conveyor for receiving the group of containers and adapted to orient the containers with their spouts in position for the containers to be filled and capped, an infeed advancer mounted in cooperation with the guide for advancing the group of containers along the guide to a filling and capping position which includes fillheads corresponding in number and position to the spouts of said group of containers, individual cappers mounted for movement into cooperation with the spouts of the filled containers of the group, means for feeding caps to said cappers, and means for actuating said cappers to apply caps to said spouts, the group of filled and capped containers being moved to a discharge position by said infeed advancer causing the next group of containers to advance along the guide to the filling and capping position.

2. A machine according to claim 1 for filling and capping containers in which the infeed conveyor supplies the containers in a single file to the infeed position with their spouts in successively-spaced relationship, said container crossfeed being mounted for travel across the infeed conveyor to push a group of a predetermined number of containers off the infeed conveyor, said container guide extending along the infeed conveyor and being shaped to receive the group of containers and orient them with their spouts upward and for sliding movement therealong, said infeed advancer being a pusher mounted for longitudinal movement relative to the container guide for engaging the last container of the group and pushing the group to the filling and capping position, said fillheads being disposed above and in alignment with the respective spouts of the group of containers moved to filling and capping-position, said individual cappers being pivotally mounted for movement from a cap-receiving position away from the spouts to a cap-applying position over the spouts of the filled containers.

3. A machine according to claim 2 in which said container crossfeed includes a pusher bar extending along the infeed conveyor and a stop shoe for engaging and stopping the advance of the next following container on the infeed conveyor as the group is pushed therefrom.

4. A machine according to claim 2 including a conveyor-full for engaging the leading container on the infeed conveyor to control the crossfeed when sufficient containers have accumulated on the infeed conveyor to form the group.

5. A machine according to claim 2 in which the container guide is in the form of a trough extending along the infeed conveyor and filling and capping position to the discharge position.

6. A machine according to claim 5 in which the infeed conveyor is continuously moving and is of a type to slide under the stopped containers thereon, and a similar takeaway conveyor is located at said discharge position.

7. A machine according to claim 5 in which the containers being filled are of substantially cube form with an angled upper corner where the spouts are located, said trough having its sides disposed relatively substantially at a right angle in V-form so that when the containers are pushed therein by said crossfeed they will be oriented with the spouts upright.

8. A machine according to claim 7 in which guide means is provided at the discharge position for guiding the group of filled and capped containers onto the take-away conveyor and reorienting them to their original position in which they were supplied at the infeed position.

9. A machine according to claim 5 in which the infeed pusher comprises means movable longitudinally of the container guide trough for engaging the last container in the group to be filled and capped and pushed onto the trough by the container crossfeed, and stop means beyond the filling and capping station associated with said trough to engage a container of the filled and capped group and prevent overfeeding of the group to be filled and capped.

10. A machine according to claim 5 in which a trough-full control means is provided in said trough for engagement by the last container in the group to control the said infeed advancer R for the trough when the crossfeed pushes a full group of containers thereinto.

11. A machine according to claim 2 in which the fillheads comprise nozzles which are spaced above the spouts of the containers moved into filling position at the filling and capping station, said nozzles being formed to create columnar streams of liquid that are of less diameter then the spouts of the container being filled.

12. A machine according to claim 2 in which the fillheads include nozzles spaced above the spouts of the containers moved into filling position at the filling and capping station, each of said fillheads comprising a flow valve controlled by a turbine meter and a preset digital counter.

13. A machine according to claim 5 including latching means for latching the containers in a fixed position in the guide trough so that the spouts are held in axial alignment with the fillheads.

14. A machine according to claim 13 in which the latching means engages the spouts.

15. A machine according to claim 14 in which said latching means comprises a longitudinally-extending latch bar mounted for movement over the trough to engage the spouts at the rear and a fixed bar along the trough for engaging the spouts at the front, said bars being notched to receive the spouts.

16. A machine according to claim 15 in which said bars overlap.

17. A machine according to claim 2 comprising means for simultaneously pivoting all of said cappers between a cap-receiving position at the rear of the fillheads and a forward cap-applying position in axial alignment with the fillheads.

18. A machine according to claim 17 including adjustable stops for determining said positions.

19. A machine according to claim 18 in which each of said cappers comprises a cap chuck on a supporting arm which is carried by a pivot shaft for horizontal movement between the rearward cap-receiving position and the forward cap-applying position and for vertical movement at such positions, and means for producing such vertical movement.

20. A machine according to claim 17 in which each of said chucks has a cap sensor to sense whether a cap is in place therein.

21. A machine according to claim 20 in which each sensor is a normally-discharging air jet.

22. A machine according to claim 19 including means for supporting caps at the rearward cap-receiving position of the cappers and means for feeding the caps thereto.

23. A machine according to claim 22 in which the cap-feeding means includes a cap-feeding chute and control means for monitoring whether or not the chute is empty.

24. A machine according to claim 22 in which the cap-feeding means includes a cap-feeding guide and control means for monitoring-for defective caps.

25. A machine according to claim 22 in which the cap-feeding means includes the guide for slidably supporting a special cap which has a tab normally secured in place, said guide having a lug which engages said tab if the cap is defective and the lug is swung out of place.

26. A machine according to claim 22 in which said cap-supporting means comprises a cap-load bar having rearwardly opening sockets longitudinally-spaced in alignment with said fillheads for receiving and supporting caps to be engaged by vertical movement of the said chucks of the respective cappers when they are pivoted to the rearward cap-receiving position.

27. A machine according to claim 26 including a cap shuttle system for supplying caps to all of said sockets and having a cap shuttle bar carrying cap-engaging flights which are in the same longitudinally-spaced relationship as said sockets, and means comprising a cap chute for supplying caps to be successively engaged by the flights of said bar.

28. A machine according to claim 27 in which the shuttle bar has depending flights with yokes which successively engage the lowermost cap in the chute, said bar being carried by a carriage, and means for reciprocating and rocking the carriage to cause the shuttle bar to successively pick-up the caps from the chute and move them into a cap shuttle track into positions opposite forwardly-opening notches formed in such track which align with the rearwardly-opening notches in the cap-load bar, and means for controlling the number of cycles of the carriage.

29. A machine according to claim 28 in which each of the yokes is of special formation to engage a cap that comprises a disc and a non-circular button spaced thereabove, said yoke having depending arms which engage the disc at diametrically-opposed points and a depending intermediate tab which engages said non-circular button to prevent rotation of the cap in the yoke.

30. A machine according to claim 23 including a forwardly and rearwardly-reciprocable crossfeed bar which extends along said cap shuttle track and is movable forwardly to cause the spaced caps to move from the track through the forwardly opening notches thereof into the respective rearwardly-opening notches of said cap load bar.

31. A machine according to claim 26 including latching means for latching the spouts of the containers in filling and capping position in the trough, said means comprising a fixed forward bar extending along and above the trough for engaging the spouts, and a longitudinally extending latch plate mounted for transverse movement above and to the rear of said trough having spout-engaging sockets to engage the spouts and clamp them against said forward bar.

32. A machine according to claim 31 in which said plates overlap.

33. A machine according to claim 17 in which said pivot shaft of each capper is mounted vertically in bearing supports for rotative and axial movement, said shaft including a spline section carrying a pinion which is held in a predetermined horizontal position, said means for pivoting all of said cappers including a horizontally reciprocable rack engaging all the pinions thereof.

34. A machine according to claim 18 in which the means for moving the pivot shaft vertically comprises a cylinder and piston unit associated therewith.

35. A machine according to claim 34 in which an adjustable stop is located at each of the forward and rearward positions of the chuck-carrying arm to precisely locate the chuck in its cap-applying and cap-receiving positions.

36. A machine according to claim 35 in which the arm in each capper is connected to the pivot shaft by a locking assembly comprising two sets of axially disposed locking rings, each of which includes two opposed mating rings having opposite tapers to tightly wedge between the shaft and a shaft-receiving socket in the arm.

37. A machine for filling and capping containers of substantially block form with a spout at an angled upper corner, which comprises a continuously-moving infeed conveyor of a type which can slide under the containers if they are stopped and which supplies the containers in a single file to a loading station with their lower ends resting on the conveyor and their opposite or upper ends having the angled corners with the spouts; a container crossfeed mounted for travel across the infeed conveyor to push a group of predetermined number accumulated on the conveyor off the conveyor and comprising a longitudinally extending pusher bar for engaging the group and a transversely extending stop for engaging the next container on the conveyor following the group, a cylinder and piston unit for controlling reciprocation of the crossfeed across the infeed conveyor; a slide guide trough mounted along the infeed container to receive the group pushed off the infeed container and which continues along a filling and capping station to a discharge station, said trough having its sides disposed relatively substantially at a right angle in V-form so that when the containers are pushed therein by said crossfeed they will be oriented with their spouts upright; an infeed container advancer mounted in cooperation with said trough and having a container-engaging pusher member reciprocable longitudinally of the trough which is in position to engage the last container of the group pushed thereinto by the crossfeed to slide the group along the trough toward the filling and capping station, a cylinder and piston unit for reciprocating said pusher member; a group of fillheads at said filling and capping station corresponding in number to the containers of the container group pushed to said station and being spaced longitudinally in a straight line over said guide trough to align with the spouts of said container group; a vertically movable stop disposed above the trough beyond the filling and capping station and movable down between containers of a previously-filled group in said trough which are pushed toward a discharge station by the following group moved into filling and capping position in the trough by the trough infeed pusher, a cylinder and piston unit for vertically reciprocating said stop; a fixed forward latch bar disposed along and above said trough for engaging the spouts of the group of containers moved into filling and capping position at the forward side thereof, a latch plate having longitudinally spaced notches in its forward edge for engaging said spouts at the rear side thereof to clamp them against said forward bar, said latch plate being mounted for forward and rearward reciprocation transversely above the trough, a cylinder and piston unit for reciprocating said latch plate; a group of individual cappers corresponding in number to said fillheads and each comprising a cap-receiving chuck; said chuck being carried by a horizontal arm connected to a vertically-disposed pivot and spline shaft mounted for both rotative and axial movement directly behind and in alignment with the fillheads, said shaft carrying a pinion splined to the shaft, a horizontally reciprocable rack to engage all of said pinions to simultaneously swing said arms to move said chucks between a rear cap-receiving position and a forward cap-applying piston, a cylinder and piston unit for reciprocating said rack, a cylinder and piston unit associated with each shaft for moving it vertically; a cap-loading bar having rearwardly-opening sockets longitudinally-spaced in alignment with said fillheads for receiving and supporting caps to be engaged by vertical movement of the said chucks when they are moved to their rearward position; a cap-shuttle bar for supplying caps in a cap shuttle track to positions opposite notches therein which open forwardly to the aligning rearwardly-opening sockets of said cap load bar; a cap feed chute for supplying caps to cap-engaging flights on said cap shuttle bar upon reciprocation and transverse rocking thereof in a predetermined cycle, a piston and cylinder unit for reciprocating said bar and a cylinder and piston unit for producing transverse rocking thereof; a forwardly and rearwardly reciprocable cap crossfeed bar extending along said cap shuttle track which moves forwardly to push the caps through the track notches into the respective sockets of said cap load bar, a cylinder and piston unit for reciprocating said cap crossfeed bar; the group of filled and capped containers when released by said latch plate and stop means being pushed by the following group to the discharge station which has a continuously-moving takeaway conveyor like the infeed conveyor extending therefrom, and guide means at the discharge station for engaging the released containers adjacent their spouts to re-orient the containers as they move onto the takeaway conveyor into the upright position in which they were supplied at the infeed station.

38. A machine according to claim 37 including adjustable stops for determining the cap-receiving and cap-applying positions of said chucks.

39. A machine according to claim 37 in which each of the fillheads includes a nozzle spaced above the associated aligned spout when the containers are located at the filling and capping station, said nozzle forming a columnar stream of less diameter than the spout.

40. A machine according to claim 39 including a flow valve in each fillhead for controlling flow to the nozzle, and a turbine meter and preset digital counter for controlling said flow valve.

41. A machine according to claim 37 in which each of said cap-chuck supporting arms is connected to its pivot shaft by a locking assembly comprising two sets of axially disposed locking rings, each of which includes two opposed mating rings having opposite tapers to tightly wedge between the shaft and a shaft-receiving socket on the arm.

42. A machine according to claim 41 including adjustable forward and rearward stops for engaging the arm in its forward and rearward pivoted positions.

43. A machine according to claim 37 in which each of said chucks has cap sensing means to determine if a cap is therein.

44. A machine according to claim 43 in which said cap-sensing means is a normally-flowing jet of air.

45. A machine according to claim 37 in which the cap applied to each container includes a disc and a non-circular button spaced thereabove, each of said flights on said cap shuttle having a yoke engaging said disc and said button to prevent rotation in the yoke.

46. A machine according to claim 37 in which the cap applied to each container comprises a disc and an upwardly projecting portion having a tab extending therebetween, a guide on which the disc slides in movement of the cap to the chute, and an inwardly-directed stop for engaging the tab, if it is broken and swings radially outwardly, to stop the slide of the cap.

47. A machine according to claim 37 in which all of said cyclinder and piston units are connected in and controlled by a pneumatic and electronic logic control circuit.

48. A machine according to claim 37 including means for detecting whether or not there is a supply of caps in said cap chute, said means comprising a detector associated with the chute which will break the circuit if there is lack of caps in the chute.

49. A machine according to claim 37 in which the circuit includes a conveyor-full limit valve having a sensor located in cooperation with the infeed conveyor which actuates the valve when a predetermined group of containers accumulates on the infeed conveyor so it actuates the cylinder and piston unit of the crossfeed to cause the crossfeed to push the group from the conveyor, and another valve connected in the circuit and having an actuator engaged by the crossfeed to return the crossfeed to its original position; a trough-full limit valve connected in the circuit to actuate said cylinder and piston unit of the container advancer and having an actuator engaged by the last container of the group pushed into said trough to advance it, and a limit valve having an actuator at an advanced position along the trough and connected in the circuit of the cylinder and piston of the container advancer so that when it is engaged it retracts the advancer to its original position; a limit valve connected in said circuit with said stop cylinder and piston unit and having an actuator located along the trough which is engaged by the container advancer to cause said unit to move the stop downwardly to stop position and then retract it; said cylinder and piston unit which reciprocates said latch plate is in circuit with said limit valve which has its actuator engaged by the container advancer to move the plate forwardly, and a limit vavle connected in the circuit with said unit engaged by the capper when it pivots forward to retract the latch bar; a reset valve is connected in the circuit to an electronic fill counter and is actuated by movement of the cappers to their rearward position to start the fill of each container to a predeterminded point; a limit valve is connected in said circuit to said cylinder and piston unit which reciprocated said rack bar and has an actuator engaged by forward movement of the latch bar to pivot the cappers forwardly, said cap shuttle counter being connected in the circuit to actuate said unit to retract the rack bar; the cylinder and piston unit for reciprocating the cap load bar is actuated to move forward by a pneumatic counter which controls the shuttle cycle; the cylinder and piston which moves the spline shaft vertically is controlled by a valve engaged by the cappers when pivoted forwardly to move it downwardly into cap applying position and by a valve engaged by the cappers when pivoted rearwardly to move it downwardly into cap-receiving position.

* * * * *